US007275508B2

(12) United States Patent
Pattullo

(10) Patent No.: US 7,275,508 B2
(45) Date of Patent: Oct. 2, 2007

(54) COMBUSTION ENGINE PULL-STARTER

(75) Inventor: George M. Pattullo, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 60 days.

(21) Appl. No.: 11/285,554

(22) Filed: Nov. 21, 2005

(65) Prior Publication Data

US 2006/0070594 A1 Apr. 6, 2006

Related U.S. Application Data

(63) Continuation-in-part of application No. 11/059,038, filed on Feb. 16, 2005, and a continuation-in-part of application No. 10/951,149, filed on Sep. 27, 2004, now abandoned.

(51) Int. Cl.
*F02M 1/02* (2006.01)

(52) U.S. Cl. ..... 123/179.18; 123/182.1; 123/185.3

(58) Field of Classification Search .. 123/185.1–185.4, 123/178.18, 182.1
See application file for complete search history.

(56) References Cited

U.S. PATENT DOCUMENTS

| | | | | |
|---|---|---|---|---|
| 2,942,599 | A * | 6/1960 | Irgens | 123/185.4 |
| 3,361,124 | A * | 1/1968 | Fend | 123/185.4 |
| 3,942,505 | A * | 3/1976 | Tillotson | 477/99 |
| 4,257,367 | A * | 3/1981 | Fujikawa et al. | 123/182.1 |
| 4,370,954 | A | 2/1983 | Asao et al. | |
| 4,803,963 | A | 2/1989 | Kleinhans | |
| 5,116,287 | A | 5/1992 | Hironaka et al. | |
| 5,361,738 | A * | 11/1994 | Iida | 123/182.1 |
| 5,379,734 | A | 1/1995 | Tsunoda et al. | |
| 5,560,345 | A | 10/1996 | Geyer et al. | |
| 5,582,143 | A * | 12/1996 | Stark et al. | 123/182.1 |
| 5,701,860 | A * | 12/1997 | Horiuchi et al. | 123/182.1 |
| 6,000,370 | A * | 12/1999 | Rickard | 123/182.1 |
| 6,508,220 | B1 | 1/2003 | Akaike et al. | |
| 6,694,941 | B2 | 2/2004 | Ueda et al. | |
| 6,755,170 | B2 | 6/2004 | Morishige et al. | |

(Continued)

FOREIGN PATENT DOCUMENTS

DE 4016224 A1 * 11/1991

(Continued)

*Primary Examiner*—Terry M. Argenbright
*Assistant Examiner*—Arnold Castro
(74) *Attorney, Agent, or Firm*—Reising, Ethington, Barnes, Kisselle, P.C.

(57) ABSTRACT

A pull-starter for a combustion engine of an engine-powered apparatus having a startup element automatically actuated upon initial pulling of a pull-cord. The pull-cord is attached to and wound around a recoil pulley, routed at least partially around a portion of a movable dampener member, and attached to a handle. The dampener member is biased toward a rest position and a portion thereof is linked to the startup element. The pull-cord is pulled to displace the dampener member away from its rest position, automatically actuate the at least one startup element, and unwind the pull-cord from around the recoil pulley and thereby rotate the recoil pulley in an unwind direction to rotate a crankshaft of the engine via a coupling. At least upon release of the pull-cord, the dampener member and the startup element automatically return to their normal state during engine operation.

55 Claims, 14 Drawing Sheets

U.S. PATENT DOCUMENTS

| | | | |
|---|---|---|---|
| 6,766,890 | B2 | 7/2004 | Husges et al. |
| 6,782,863 | B2 | 8/2004 | Leasure et al. |
| 6,848,405 | B1 | 2/2005 | Dow et al. |
| 2004/0250786 | A1 | 12/2004 | Kruse et al. |
| 2004/0250787 | A1 | 12/2004 | Tohyama |

FOREIGN PATENT DOCUMENTS

| | | |
|---|---|---|
| DE | G 94 02 559 | 6/1995 |
| DE | 196 18 699 | 11/1997 |
| JP | 02-185671 | 7/1990 |
| JP | 03-121267 | 5/1991 |

* cited by examiner

COMBUSTION ENGINE PULL-STARTER

REFERENCE TO RELATED APPLICATIONS

This application is a continuation-in-part of U.S. patent applications, Ser. No. 10/951,149, filed Sep. 27, 2004 now abandoned, and Ser. No. 11/059,038, filed Feb. 16, 2005.

FIELD OF THE INVENTION

The present invention relates generally to a combustion engine starter and more particularly to a pull-starter for an engine-powered apparatus that dampens pulling forces and may additionally automatically actuate a start element associated with the engine-powered apparatus.

BACKGROUND OF THE INVENTION

For many decades small internal combustion engines, such as those used for recreational vehicles and landscaping tools like chain saws, trimmers, tractors, and lawn mowers, have typically used mechanical, manually-operated recoil pull-starters. In a direct recoil pull-starter, an operator of the vehicle or garden tool pulls a cord which is wound about a recoil pulley to rotate the recoil pulley in a first direction. The rotating recoil pulley rotates an engine crankshaft, via a one-way coupling, to start a combustion engine. The one-way coupling allows the crankshaft of the running engine to rotate freely relative to the recoil pulley. When the cord is released by the operator, the recoil pulley automatically reverses rotation, by way of a torsional recoil spring, to retract the cord back around the recoil pulley.

The direct recoil pull-starter is generally satisfactory, but in some applications, may be disadvantageous. In the event that an engine was shut down with the piston before top dead center and with the exhaust and intake valves closed (i.e. during a compression stroke of the engine), pulling of the starter cord may be difficult to say the least. In fact, the cord may actually snap out of an operator's hand back into the pulley housing because the trapped air within the combustion chamber resists compression, essentially keeping the piston and crankshaft in their arbitrarily shutdown positions. The operator must exert a sufficiently large pulling force to overcome such internal resistance during a compression stroke of a piston in the engine.

Making matters more difficult, engine emissions regulations are becoming more stringent, thereby forcing engine manufacturers to increase the compression ratio of their engines to increase power and improve the emissions-to-power ratio. But higher compression ratios yield higher compression forces that must be overcome to start the engine, thereby making such engines relatively more difficult to start by hand. And higher compression ratios also exacerbate the problem of piston bounce between compression strokes during starting, wherein the operator experiences a jerking motion in the pull cord that gets transmitted through the piston, crankshaft, flywheel, coupling, and the pulley to which the cord is attached. Such problems are intensified with engines that have neither a relatively large weighted flywheel nor a slip clutch between an output shaft of the engine and a load.

To alleviate such conditions, many devices use a so-called stored energy recoil spring starter wherein an operator repeatedly pulls a cord, which is wound about a recoil pulley, to rotate the recoil pulley in a wind up direction to progressively wind up a ratchet engaged starter spring. When released by pressing a ratchet release button and release mechanism, the starter spring suddenly unwinds to rotate the recoil pulley in a starting direction opposite the wind up direction. The rotation of the pulley causes a crankshaft to rotate, via a one-way coupling arrangement therebetween, to start the engine. Unfortunately, however, these stored energy starters often require an operator to yank repetitively on the pull cord and are often bulky and heavy in order to accommodate a sufficiently powerful starter spring to overcome the high resistances incurred when starting the engine.

In recent years, however, many manufacturers have incorporated torsional damper springs within recoil pulleys of direct recoil starters. At least one such starter includes a rotatable pulley, a cord wound around the pulley, a recoil spring to rewind the cord, a torsional damper spring coaxial with the pulley and having one end biased against a portion of the pulley and having an opposite end biased against a centrifugal ratchet provided on an engine flywheel. This opposite end of the damper spring is arranged to releasably engage with the centrifugal ratchet so as to transmit forward rotation of the pulley to the flywheel through the ratchet. With this configuration, the shock caused by the engine is absorbed by the damper spring and a rotating force from the pulley is stored by the damper spring. Unfortunately, however, this approach may require redesigning and repackaging one or more of conventional pulleys, flywheels, and coupling mechanisms therebetween. Also, this dampening mechanism is one-dimensional in that it fails to provide additional functionality besides dampening.

SUMMARY OF THE INVENTION

According to one embodiment of a pull-cord start system of a combustion engine, a remote start assist device is automatically actuated upon an initial pull of a pull-cord of a recoil starter assembly. The assembly has a coupling which intermittently engages a recoil pulley of the recoil starter assembly about which the cord is wound. Upon the initial pull of the cord, a shuttle of the coupling moves generally with the pulley, pulling upon a linkage constructed and arranged to actuate the external start device. Upon release of the cord, the shuttle and the remote start assist device automatically re-align themselves.

Preferably, the coupling has a roller engaged rotatably to the shuttle and disposed radially outward from the pulley. A winding of a plurality of windings of the cord is wound or encompasses both the pulley and the roller with the remaining windings being either wound about just the pulley and/or withdrawn from a housing of the recoil starter assembly which generally houses both the pulley and the shuttle.

Preferably the start assist device is a carburetor having a choke valve operatively associated with a throttle valve. Upon initial pulling of the cord of the recoil starter assembly, movement of the coupling pulls upon a linkage, which closes the choke valve and partially opens the throttle valve. Upon release of the cord, the pulley automatically recoils the cord and the coupling moves back, thus negating the pulling force upon the linkage which allows the yieldably biased open choke valve to partially open to an engine warm-up position while the throttle valve remains in a partially open position until the operator actuates a throttle pedal or trigger to increase engine speed.

Another embodiment of a pull-starter is adapted for use with a combustion engine that preferably has a crankshaft and a flywheel attached to the crankshaft. The pull-starter is adapted to start the combustion engine and includes a housing, a recoil pulley carried by the housing, and a torsional biasing member operatively engaged between the housing and the recoil pulley to rotatably bias the recoil pulley in a wind up direction. The pull-starter also includes a movable dampener device that is at least partially mounted to the housing and that includes a movable dampener member, a reaction member such as a roller carried by the movable dampener member, and a dampener biasing member operatively engaged between the housing and the movable dampener member to bias the movable dampener member to a rest position. The pull-starter further includes a flexible member wound about the recoil pulley and routed at least partially about the reaction member of the movable dampener device, wherein the flexible member terminates in a handle end. Pulling of the handle end of the flexible member displaces the movable dampener member away from its rest position against the bias force of the dampener biasing member and rotates the recoil pulley in an unwind direction. Rotation of the recoil pulley is preferably imparted to the engine via a one-way coupling interposed between the flywheel and recoil pulley.

Preferably, the pull-starter is adapted for use with an engine-powered apparatus that includes a startup element, such as an engine start-assist device or an apparatus safety lock, having a linkage operatively connected therewith. Preferably, the movable dampener member is operatively connected to the linkage and, thus, the startup element. Accordingly, the pull-starter is preferably adapted to start the combustion engine and to actuate the startup element, wherein pulling of the handle end of the flexible member displaces the movable dampener member away from its rest position to displace the linkage and the startup element.

At least some of the objects, features and advantages that may be achieved by at least certain embodiments of the invention include providing a reliable starting engine having a simplified start-up procedure, a pull-starter that yields a smooth and gradual pulling effort for engine starting, reduces shock transmitted through a pull-cord to an operator, reduces or eliminates pull-cord kickback, automatically actuates various startup elements of an engine-powered apparatus, reduces or eliminates engine stalling on overly rich mixtures of fuel-and-air during engine startup, automatically places a throttle and choke valve in partially open positions upon engine startup and automatically returns the choke valve to an "off" or fully open position after the engine has successfully started, is of relatively compact construction, simple design, low cost when mass produced, rugged, and durable, reliable, requires little to no maintenance and adjustment in use, and in service has a long useful life.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
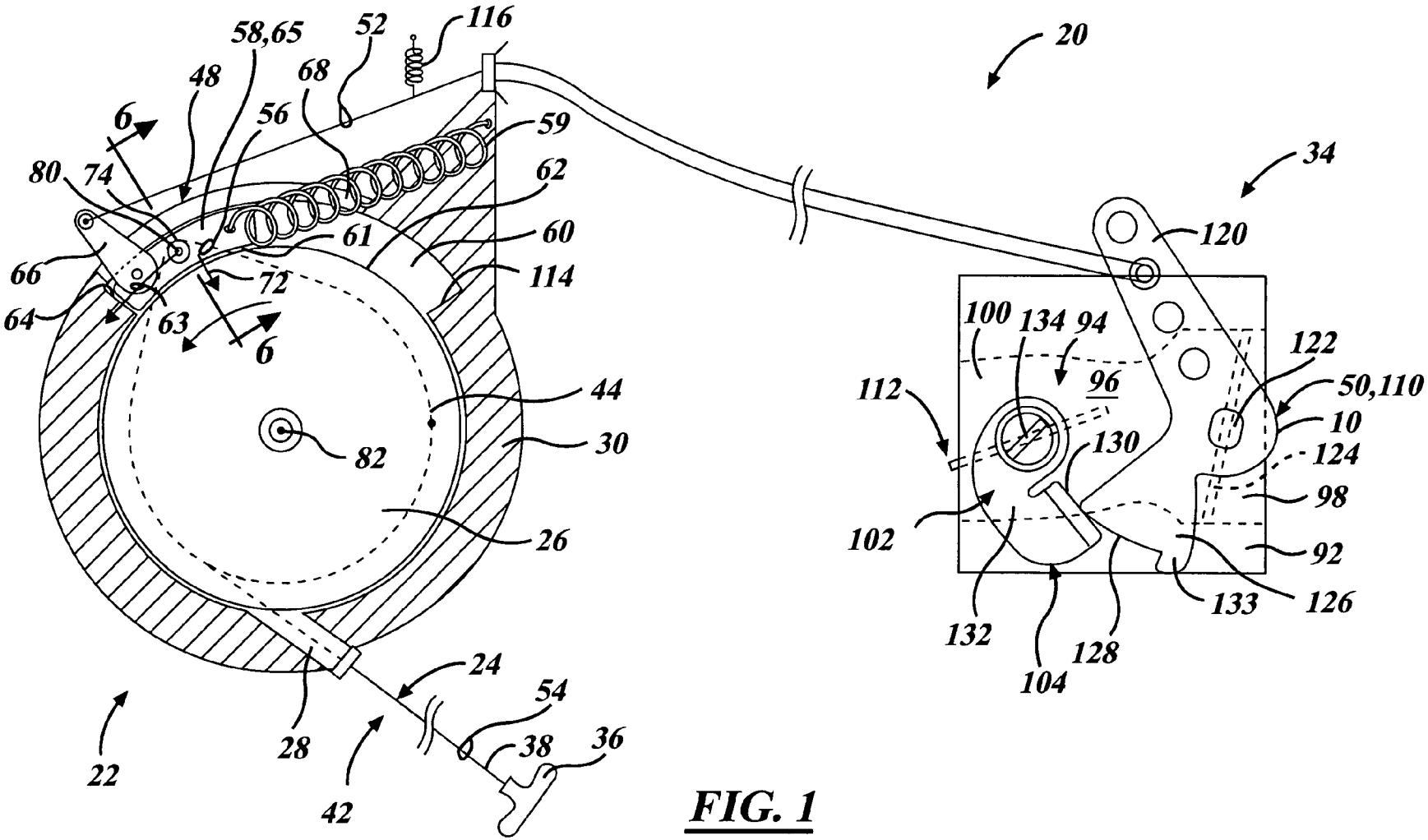
FIG. 1 is a combined partial section view of a recoil starter assembly of a pull-cord start system illustrated in an unwound state, and a side view of a carburetor of the pull-cord start system linked to the starter assembly and illustrated in a closed position with a throttle valve substantially open.
Figure 2:
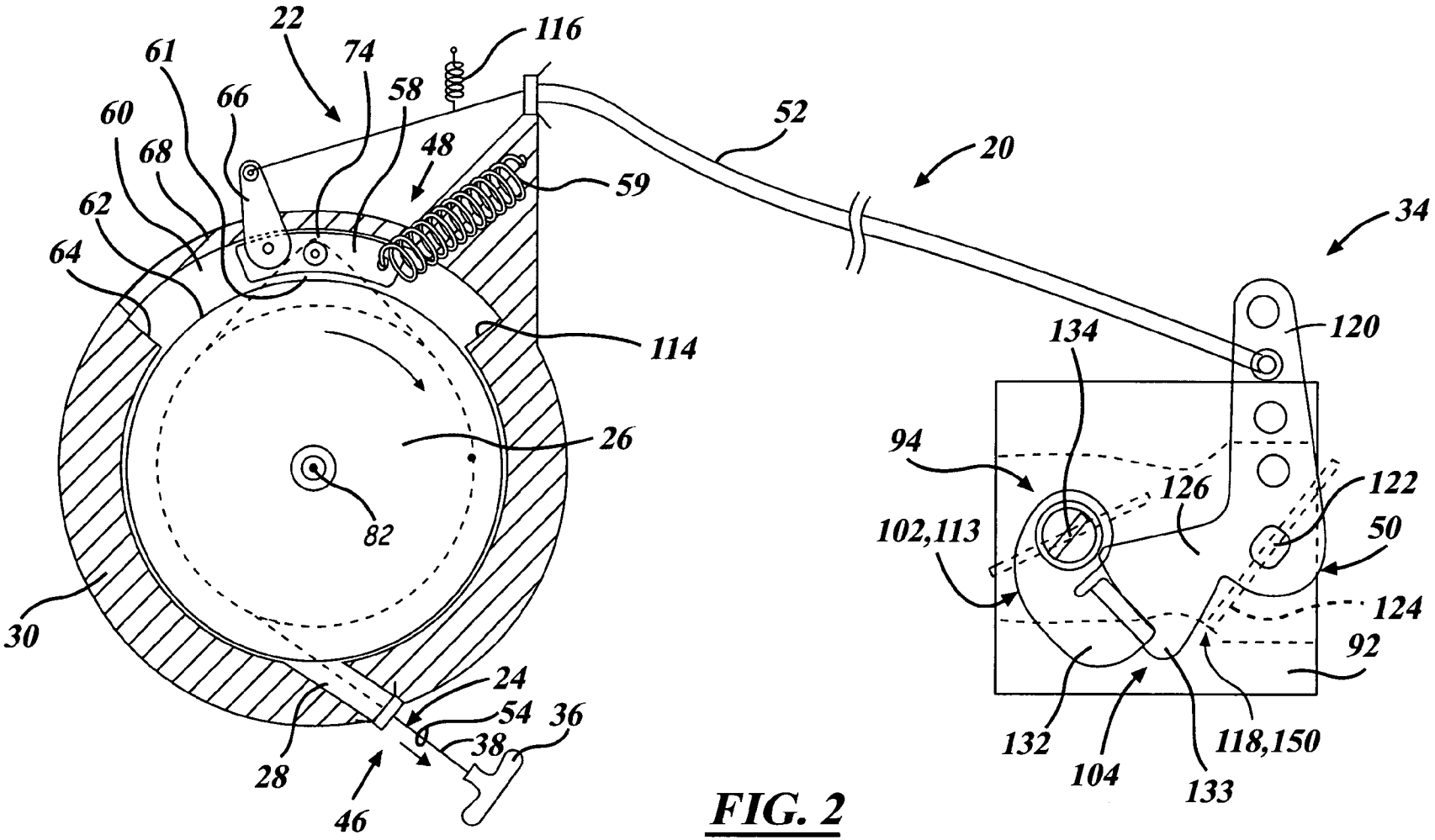
FIG. 2 is a section view of the pull-cord start system illustrated in a recoiling state with the carburetor illustrated in an engine warm-up orientation.
Figure 3:
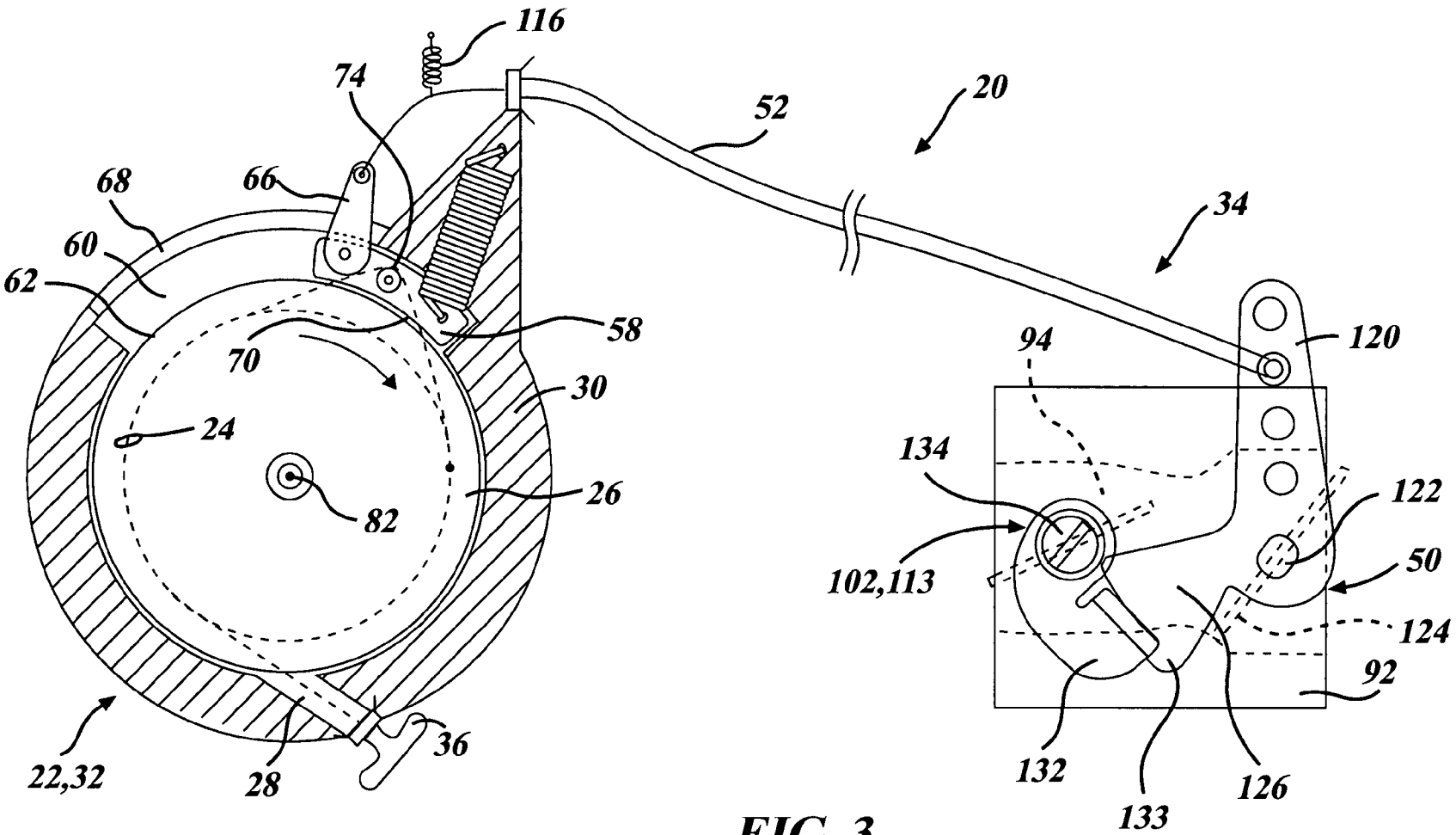
FIG. 3 is a section view of the pull-cord start system illustrated in a recoiled state wherein a movable dampener member is in its rest position and wherein the choke valve is illustrated in the engine warm-up orientation.
Figures 9, 10:
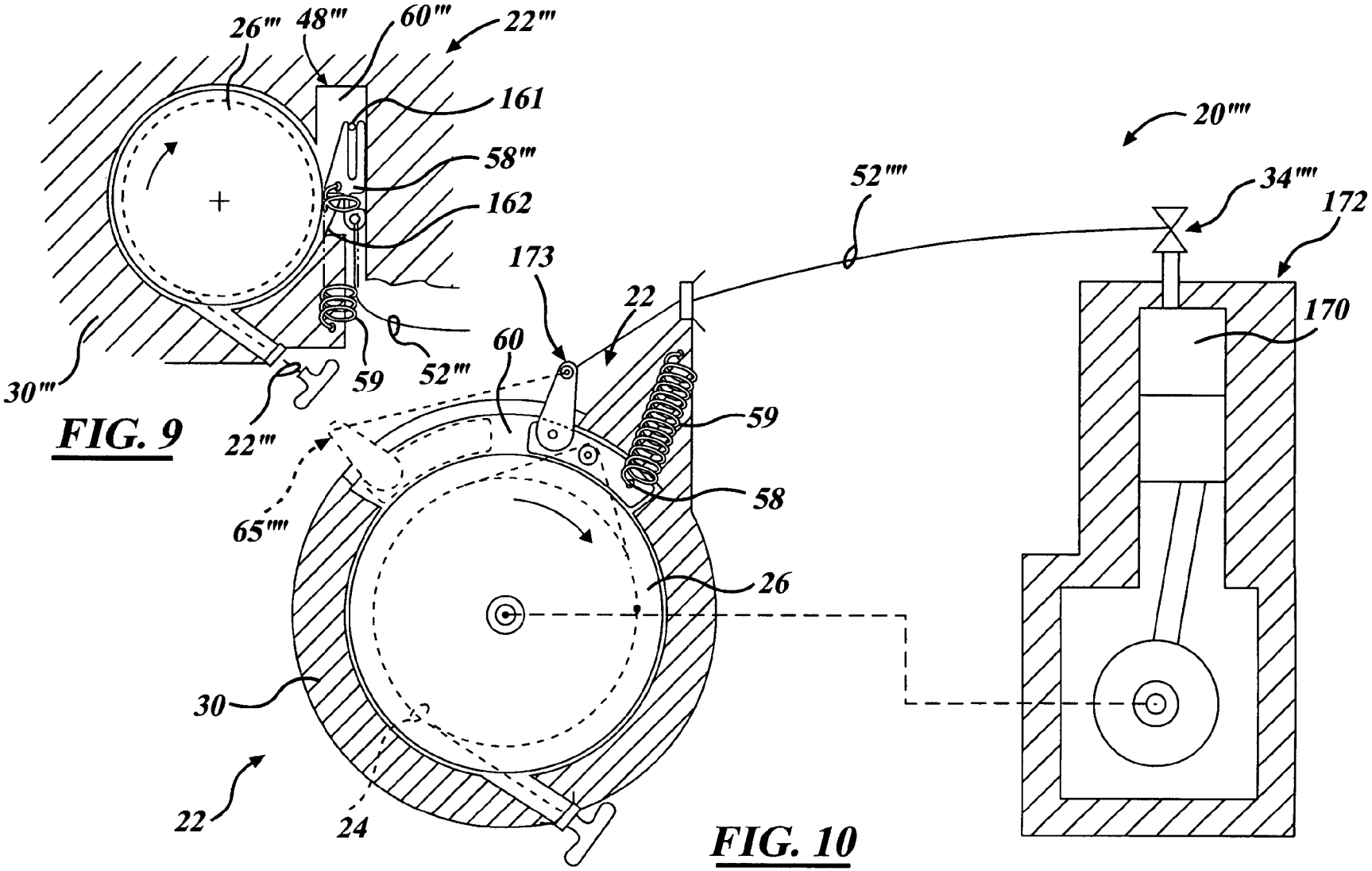
FIG. 9 is a section view of a third modification of a pull-cord start system.
FIG. 10 is a section view of a fourth modification of a pull-cord start system.

Referring in more detail to the drawings, FIGS. 1-3 illustrate a pull-starter or pull-cord start system 20 of the present invention preferably utilized on small displacement internal combustion engines which commonly require a manual pull-cord recoil starter assembly 22 for starting the engine. When a pull-cord 24 of the recoil starter assembly 22 is pulled by an operator against a rotational bias of a pulley or spindle 26 through a cord conduit 28 carried by a housing 30 of the assembly 22, a crank shaft of the engine is rotated at a speed sufficient to start the engine. The pulley 26 is connected by a one way clutch or coupling to drive the crankshaft as the cord is pulled and to permit the crankshaft to freely rotate relative to the pulley when the engine is running. During initial unwinding of the cord 24 from a recoiled state 32 (as best shown in FIG. 3), the pull-cord start system 20 not only begins to rotate the crankshaft, but also actuates an external startup element or start assist device 34 which may include, but is not limited to, a carburetor as illustrated in FIGS. 1-3 and 4-5, and/or a combustion chamber pressure relief valve as illustrated in FIG. 10.

Figure 6:
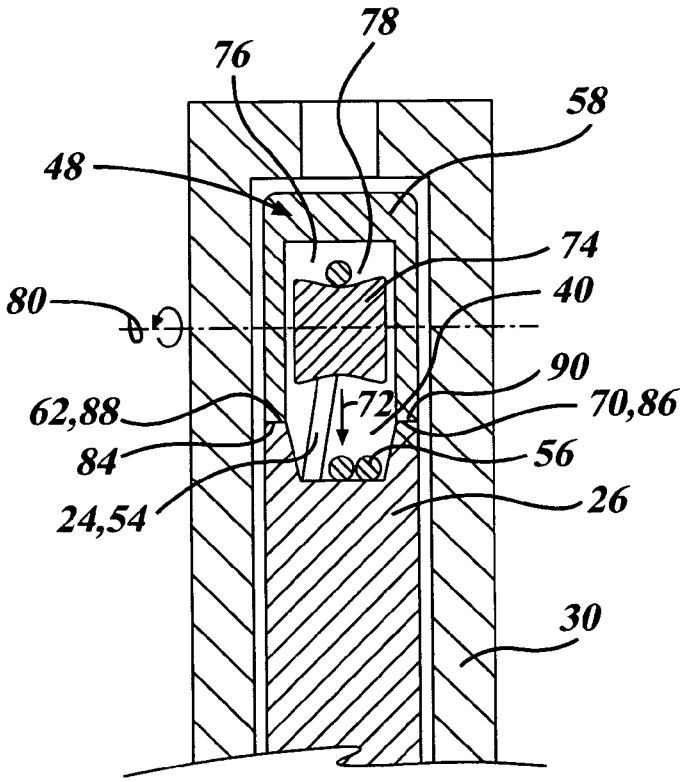
FIG. 6 is a partial section view of the pull-cord start system taken along line 6-6 of FIG. 1.

When starting the engine, the operator manually grasps a handle 36 attached to a first distal end 38 of the cord 24 and pulls the cord 24 outward from the housing 30 which turns the pulley 26 in a counter-clockwise direction (as viewed in FIG. 1) against the bias of a torsional spring (not shown) generally engaged between the pulley 26 and the housing 30. The operator must pull the cord with sufficient strength to overcome the bias of the pulley recoil spring which would otherwise cause the cord 24 to rewind back into the housing 30 within a circumferential groove 40 carried by the pulley 26 and opened generally radially outward, as best illustrated in FIG. 6. As the cord 24 is pulled outward toward an unwound state 42 (as best illustrated in FIG. 1) the recoil pulley 26 engages the crankshaft of the engine causing the piston(s) to reciprocate with sufficient speed to start the engine. When the cord 24 is released by the operator, the recoil spring (not shown) causes the pulley 26 to rotate clockwise through a series of complete revolutions. Because an opposite second end 44 of the cord 24 is engaged directly to the pulley 26, the cord 24 travels with the pulley and recoils back into the housing 30 (i.e. a recoiling state 46 as best illustrated in FIG. 2) until the handle 36 nestles or seats against the housing 30 proximate to the conduit 28, thus placing the recoil starter assembly 22 into the recoiled state 32, as best illustrated in FIG. 3 wherein the dampener member or shuttle 58 is in its rest position.

The recoil starter assembly 22 interacts with the start assist device or carburetor 34 via a movable dampener device or coupling 48 of the assembly 22 which connects to a choke valve 50 of the remotely located carburetor 34 by an elongated linkage 52, which is preferably a Bowden wire. Those of ordinary skill in the art will recognize that the coupling 48 may be a releasable or slip style coupling and is preferably both a dampener for dampening pulling forces required to overcome resistance incurred when pull-starting the engine as well as an actuator used to actuate the start assist device 34 via the linkage 52. The cord 24 has a plurality of windings, with a first winding 54 having the first cord end 38 connected directly to the handle 36 and a last winding 56 having the second end 44 connected to the pulley 26. Automatic positioning of the choke valve 50 to assist in starting the engine occurs generally during the first counter-clockwise rotation of the pulley 26 from the recoiled state 32, and thus during the withdrawal of the first winding 54 from the housing 30. This enables the remaining windings or revolutions of the pulley 26 to actually start the engine after the choke valve 50 and throttle valve of the carburetor 34 have been automatically positioned for optimum starting.

When the recoil starter assembly 22 is in the recoiled state 32, a dampener member or shuttle 58 of the coupling 48 is preferably in an at rest position 114 in a circumferentially extending channel 60 defined radially between the housing 30 and a generally circular surface or pair of peripheral edges 62 of the pulley 26. The pulley groove 40 is defined laterally between the axially spaced edges 62 of the pulley 26. A dampener biasing member 59 is preferably interposed between the shuttle 58 and the housing 30, as shown in one example in FIG. 3. The biasing member 59 may include, but is not limited to, a tension or compression spring, a tension or compression elastic member, a viscous dampener member, and other equivalents. As shown in FIG. 3, the biasing member 59 is preferably sized and positioned so as to maintain the shuttle 58 is in its rest position when the dampener biasing member 59 is preferably neither in tension nor in compression.

During the initial pull of the cord 24 or during withdrawal of the first winding 54 from the housing 30, the shuttle 58 of the coupling 48 moves counter-clockwise with the pulley 26 and within the channel 60 due to a frictional interface 61 engagement between the shuttle 58 and the pulley 26, and/or a torsional force (indicated by arrow 63) created by the orientation of the coupling 48 with the particular winding generally disposed within the housing 30 and adjacent the conduit 28. The shuttle 58 moves counter-clockwise until the shuttle 58 contacts a stop 64 carried by the housing 30 at which point the shuttle 58 is in an actuated state 65. Upon contact, the shuttle 58 has moved a sufficient angular distance to actuate the start assist device or carburetor 34 via the linkage 52 which is connected to a radially projecting lever 66 of the shuttle 58 that extends through a slot 68 of the housing 30. With the shuttle 58 in the actuated state 65 or pressed against the stop 64, the remaining windings of the cord 24 are withdrawn from the housing 30 by the operator's continuing pull causing the pulley 26 to continue its rotation.

During this remaining or continuing pull, the frictional interface 61, formed by the contact between a radially inward concave face 70 of the shuttle 58 and the axially outward lying edge portions of the circular surface 62 of the pulley 26, is overcome by the pulling force exerted upon the cord 24 by the operator. Therefore, the pulley 26 continues to rotate counter-clockwise as the cord 24 is withdrawn from the housing 30 and as the coupling 48 remains stationary. The circumferential location of the stop 64 generally lies within the range of ninety to one hundred and twenty degrees away and in a clockwise direction from the conduit 28 which generally locates the channel 60 (i.e. coupling travel range) diametrically opposite the conduit 28. This generally diametrically opposed orientation assures that the coupling 48 does not become bound or entangled proximate to the conduit 28 of the housing 30.

The frictional interface 61 between the surface 70 of the shuttle 58 and the surface 62 of the pulley 26 is induced or caused by a reactive force (identified as arrow 72) directed generally radially inward with respect to the pulley 26. Force 72 is produced by the looping of one of the windings of the plurality of windings of the cord 24 both over a reaction portion or roller 74 of the coupling 48, supported rotatably by the shuttle, and the pulley 26. The roller 74 is disposed radially outward from the pulley 26 and is substantially centered axially with respect to the pulley over the groove 40. An alcove 76 of the shuttle 58 houses the roller 74 and opens radially inward so that any one winding of the cord 24 can be diverted from the groove 40 of the pulley 26, as it is routed over the roller 74 and then return back into the groove 40.

The contour or profile of the roller 74 forms a circular valley or V-groove 78 which axially centers the cord 24 to the roller 74. A rotational axis 80 of the roller 74 is orientated substantially parallel to a central axis 82 of the pulley 26. Pulling of the cord 24 by the operator creates a tension in the cord which biases the roller 74 and shuttle 58 radially inward against the pulley 26. This biasing force is represented by arrow 72. Because the cross section of the shuttle 58 is generally U-shaped and inverted, as illustrated in FIG. 6, the surface 70 has two parallel edge portions 84, 86 which frictionally contact the two respective rim portions 88, 90 of the surface 62 of the pulley 26. The cord windings which are contained within the housing 30 are therefore located within either the groove 40 of the pulley 26 or the alcove 76 of the shuttle 58.

When the recoil starter assembly 22 is in the recoiled state 32, as best shown in FIG. 3, the first winding 54 of the cord 24 is both wound about the pulley 26 and over the roller 74 of the shuttle 58 of the coupling 48. During pulling of the cord 24, the tensile force produced is translated into the radial or normal force 72 and a tangential force or generally the torsional force 63. The normal force 72 causes the shuttle 58 to frictionally engage the radial surface 62 of the recoil pulley 26 and the tangential force 63 contributes toward the circumferential movement of the shuttle 58. Because the tangential force 63 generally overcomes any resistive biasing force of the start assist device 34, the shuttle 58 moves counter-clockwise with the pulley 26 until the shuttle 58 contacts the stop 64 carried by the housing 30. Upon contact, the operator must exert a sufficient amount of additional pulling force to generally overcome the frictional force 72 between the shuttle 58 and the pulley 26.

With continued pulling of the cord 24 the next successive winding which was generally wound a full three hundred and sixty degrees about the pulley 26, and not the roller 74, now enters the alcove 76 and travels over the roller 74, back down into the groove 40 of the pulley 26, and out of the conduit 28 to exit the housing 30. Each winding successively travels over the roller 74 as it leaves or exits the housing 30 until the last winding 56 comes to a rest over the roller 74, as best illustrated in FIG. 1 as the unwound state 42.

Figure 4:
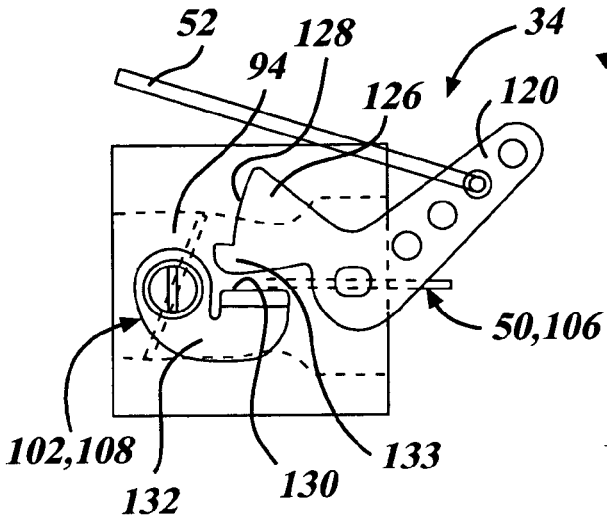
FIG. 4 is a section view of the carburetor of the pull-cord start system with the throttle valve at idle and the choke valve fully open.
Figure 5:
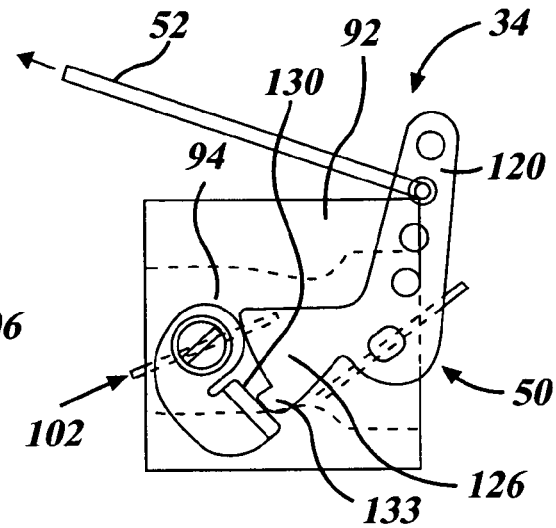
FIG. 5 is a section view of the carburetor of the pull-cord start system illustrating the throttle valve opening from the idle position and the choke valve closing from the open position to a partially closed position when the cord is pulled from the released state.

More specific to the carburetor 34, a body 92 carries a conventional fuel-and-air mixing passage 94 having a venturi region 96 disposed between an upstream region 98 and a downstream region 100. A butterfly-type throttle valve 102 operatively engages the butterfly-type choke valve 50 via a cam linkage 104. Both valves 50, 102 are engaged rotatably to the body 92 with the choke valve 50 disposed in the upstream region 98 and the throttle valve 102 disposed in the downstream region 100. Referring to FIG. 4, when the engine is either shut down or running at normal operating temperatures and idling speed, the choke valve 50 is biased into a full open position 106 and the throttle valve 102 is biased into an engine idle position 108 by respective torsional springs (not shown).

When the cord 24 of the recoil starter assembly 22 is initial pulled, the shuttle 58 of the coupling 48 moves toward its stop 64 and, thus, the Bowden wire 52 moves for a distance pre-established by the location of the stop 64 of the housing 30 which is far enough to move the butterfly-type choke valve 50 from the spring biased full open position 106 to an actuation or closed position 110, as best illustrated in FIG. 1. This counter-clockwise rotation of the choke valve 50 causes engagement of the cam linkage 104 between the valves 50, 102 which rotates the throttle valve 102 clockwise against the biasing force of the throttle spring from the idle position 108 (as viewed in FIG. 4) and into an engine cold-start position 112 (as viewed in FIG. 1).

When the cord is released, the clockwise rotation of the pulley 26 moves the coupling 48 clockwise away from the stop 64 and toward a recoil stop 114 carried by the housing 30 and which preferably defines the opposite end of the channel 60. Upon release of the cord, the shuttle 58 and the remote start assist device automatically re-align themselves, wherein the bias force of the biasing member 59 acts on the shuttle 58 to cause the shuttle 58 to move toward the recoil stop 114 creating a degree of slack within the Bowden wire 52 which can be taken-up by a slack retention device 116, as illustrated in FIG. 2.

This release of tension within the Bowden wire 52 also enables the biasing force of the choke spring to rotate the choke valve 50 clockwise from the closed position 110 (as viewed in FIG. 1) and into an engine warm-up or partial choke state 118 (as viewed in FIG. 2). During this rotation of the choke valve 50, the cam linkage 104 and the cam surface 128 slightly close the throttle valve 102, moving the throttle valve 102 from the cold-start position 112 to an engine warm-up or fast idle position 113, which decreases the richness of the fuel-and-air mixture delivered to the engine yet is still richer than normal running conditions. Further clockwise rotation of the choke valve 50 from the warm-up state 118 and into the open position 106 is prevented by a latch or tab 133 of the cam linkage 104. The cam linkage 104 is released when the operator manually actuates the throttle which causes the throttle valve 102 to rotate in an opening direction or clockwise against the bias of the throttle spring, thus releasing or clearing the choke valve 50 which moves to the full open position 106.

The Bowden wire or linkage 52 is engaged pivotally to a distal end of an arm 120 of the choke valve 50 which projects radially outward from an end of a rotating shaft 122 of the choke valve 50. The shaft 122 is rotatably engaged to the body 92 and traverses the upstream region 98 of the fuel and air mixing passage 94. Pivoting action of the arm 120 via pulling of the linkage 52 causes the shaft 122 to rotate and a plate 124 of the valve 50 disposed operatively in the passage 98 to pivot thus opening or closing the passage 98.

A radially projecting member 126 of the cam linkage 104 projects radially outward from the same end of the shaft 122 of the choke valve 50. The projecting member 126 has a cam surface 128 which contacts a contact face 130 of a lever 132 projecting radially outward from a rotating shaft 134 of the butterfly-type throttle valve 102. As the choke valve 50 rotates from the open position 106, which is preferably biased open by a torsional spring not shown, to the full closed position 110, the cam surface 128 of the cam linkage 104 carried by the choke valve 50 contacts the contact face 130 of the cam linkage 104 carried by the throttle valve 102, causing the throttle valve 102 to move from the biased engine idle position 108 (as best illustrated in FIG. 4) to the partially open or engine cold-start position 112. Consequently, whenever the cord or starter rope 24 is being pulled generally beyond the first winding 54, the choke valve 50 will be tightly closed and the throttle valve 102 will be in the cold-start position 112 unless the throttle is simultaneously actuated by the operator.

Alternatives to the cam linkage 104 can be incorporated into the carburetor 34. One such modification is the choke and throttle valve cam linkage taught in U.S. Pat. No. 6,848,405, which is assigned to the assignee hereof and is incorporated herein by reference in its entirety.

Release of the cord 24 by the operator will cause the coupling 48 to move clockwise with the spring-induced recoiling of the pulley 26, as best shown in FIG. 2. The torsional spring bias of the choke valve 50 causes the choke valve 50 to slip back or rotate clockwise to the partially open or warm-up state 118, as best shown in FIG. 2, which is pre-established by a tab 133 projecting radially outward from the cam surface 128. More specifically, as the choke valve 50 rotates clockwise from the closed position 110 to the warm-up state 118, due to the bias of the choke spring, the cam surface 128 carried by the choke valve 50 slides along the cam face 130 carried by the throttle valve 102, causing the throttle valve 102 to slightly close. This sliding action continues until the tab 133 is caught by or contacts the distal end of the lever 132, at which point the choke valve 50 is in the warm-up state 118 and the throttle valve is in the warm-up position 113. When the operator opens the throttle after the engine has sufficiently warmed-up, thus rotating the throttle valve 106 clockwise which moves the lever 132, the cam linkage 104 is released and the choke valve 50 rotates to the full open position 106 via the biasing force of the choke spring.

First Modification

Figure 7:
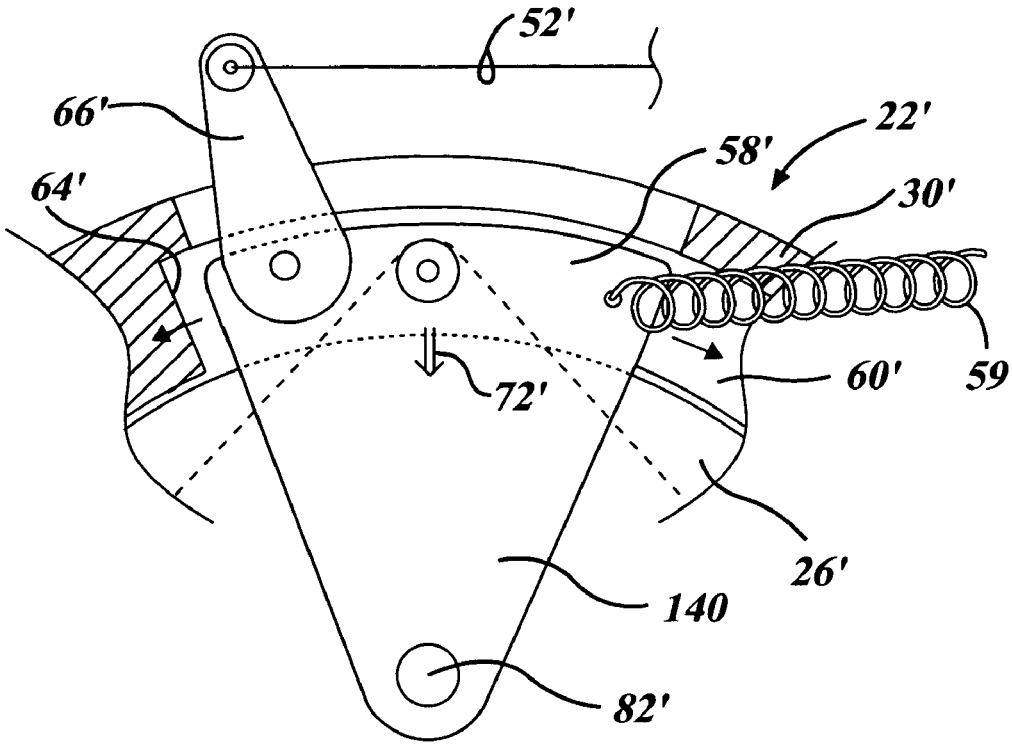
FIG. 7 is a partial section view of a first modification of a pull-cord start system.

Referring to FIG. 7, a first modification of the first embodiment is illustrated wherein the frictional interface 61 between the coupling 48 and the pulley 26 is eliminated. Instead, the shuttle 58', illustrated in FIG. 7, has a pair of generally pie shaped plates 140 which project radially inward on either side of a recoil pulley 26' journalled for rotation on an axis or shaft 82' of the pulley. The plates 140 radially space or hold the shuttle 58' outward from the pulley 26'. With this arrangement, the shuttle 58' moves circumferentially with respect to the shaft 82' via generally a tangential force 63' produced when pulling the cord 24' or when the pulley 26' is recoiling.

Second Modification

Figure 8:
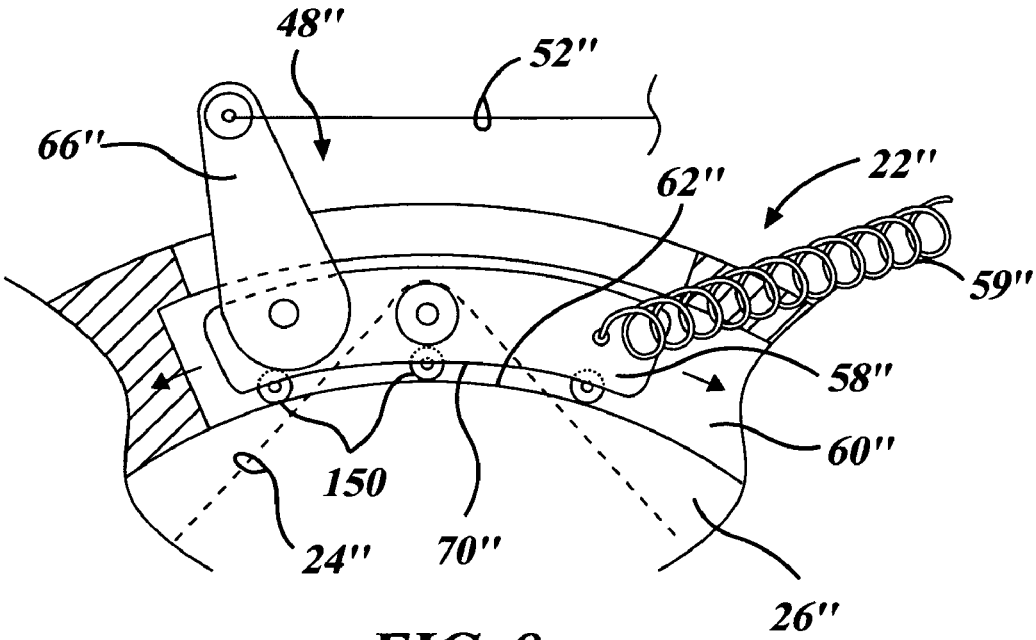
FIG. 8 is a partial section view of a second modification of a pull-cord start system.

Referring to FIG. 8, a second modification of the present invention is illustrated wherein the friction produced between a surface 70" of a shuttle 58" and a surface 62" of a pulley 26" is reduced (relative to the frictional interface 61 of the first embodiment) by a series of wheels or roller bearings 150 disposed therebetween.

Third Modification

Referring to FIG. 9, yet a third modification of the present invention is illustrated wherein a coupling 48''' of a recoil starter assembly 22''' has a fork shaped shuttle 58''' which moves linearly and tangentially with respect to a recoil pulley 26''' to pull upon a linkage 52''' thereby actuating a start assist device (not shown). The linear movement of the shuttle 58''' is guided by a channel 60''' and a stationary pin 161 which projects generally laterally past and between the prongs of the fork shaped shuttle 58'''. With the initial pull of a pull-cord 24''', the pulley 26''' rotates counter-clockwise and a ramped projection 162 of the coupling 48''' which projects radially outward from the pulley 26''' engages the forked shuttle 58''' causing it to move linearly along the channel 60''' carried by a housing 30''' of the assembly 22'''. Once the shuttle 58''' has moved and pulled upon the linkage 52''' to actuate an external start assist device, it shall remain in the present position until the external start assist device return pulls upon the linkage 52'''.

Fourth Modification

Referring to FIG. 10, a presently preferred fourth modification of a pull-cord start system 20'''' is illustrated wherein a start assist device 34'''' is actuated by the recoil starter assembly 22 (viewed in FIG. 1) having a releasable clutch coupling with a torsion spring as previously described. The start assist device 34'''', however, is not the carburetor of FIG. 1, but instead is a yieldably biased-closed, pressure relief valve which when opened, relieves any air pressure within a combustion chamber 170 of an engine 172. The valve 34'''' is yieldably biased closed and opens to relieve any air pressure trapped in the combustion chamber 170 when the shuttle 58 is moved to an actuation state 65 by the pulling of the cord 24 as previously described. Relieving this pressure upon the initial pull of the pull-cord 24 prevents any potential kick-back of the pull-cord 24 during starting of the engine. When the pull-cord 24 is released, the shuttle 58 moves out of the actuation state 65 and the valve 34'''' closes to its normally biased position. The engine starts when the torsion spring is sufficiently wound and releases to rotate the crankshaft.

Generic Embodiment—Structure

Figure 11A:
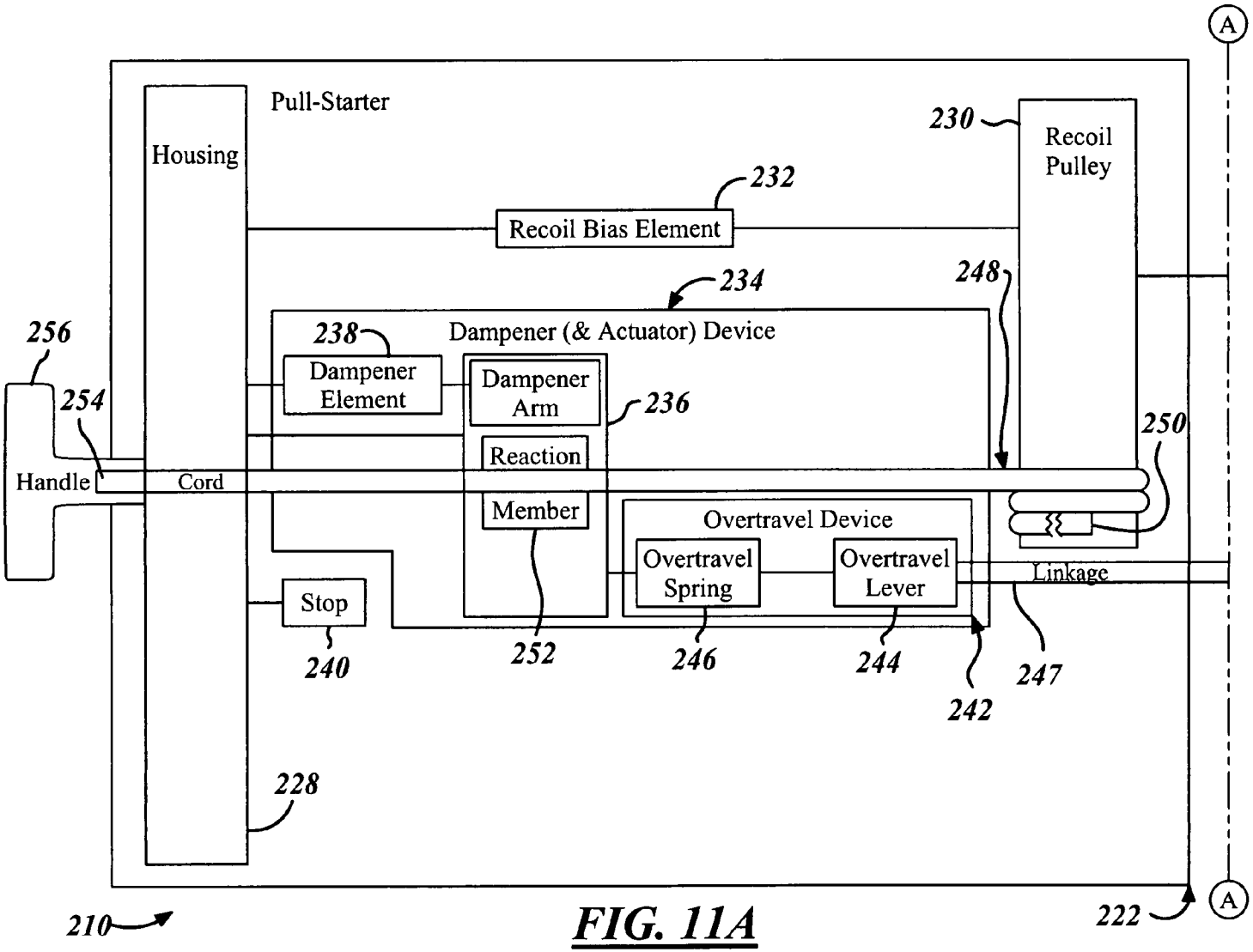
FIGS. 11A and 11B together illustrate a mechanical block diagram of a generic embodiment of an engine-powered apparatus having a generic embodiment of a pull-starter with a movable dampener device.
Figure 11B:
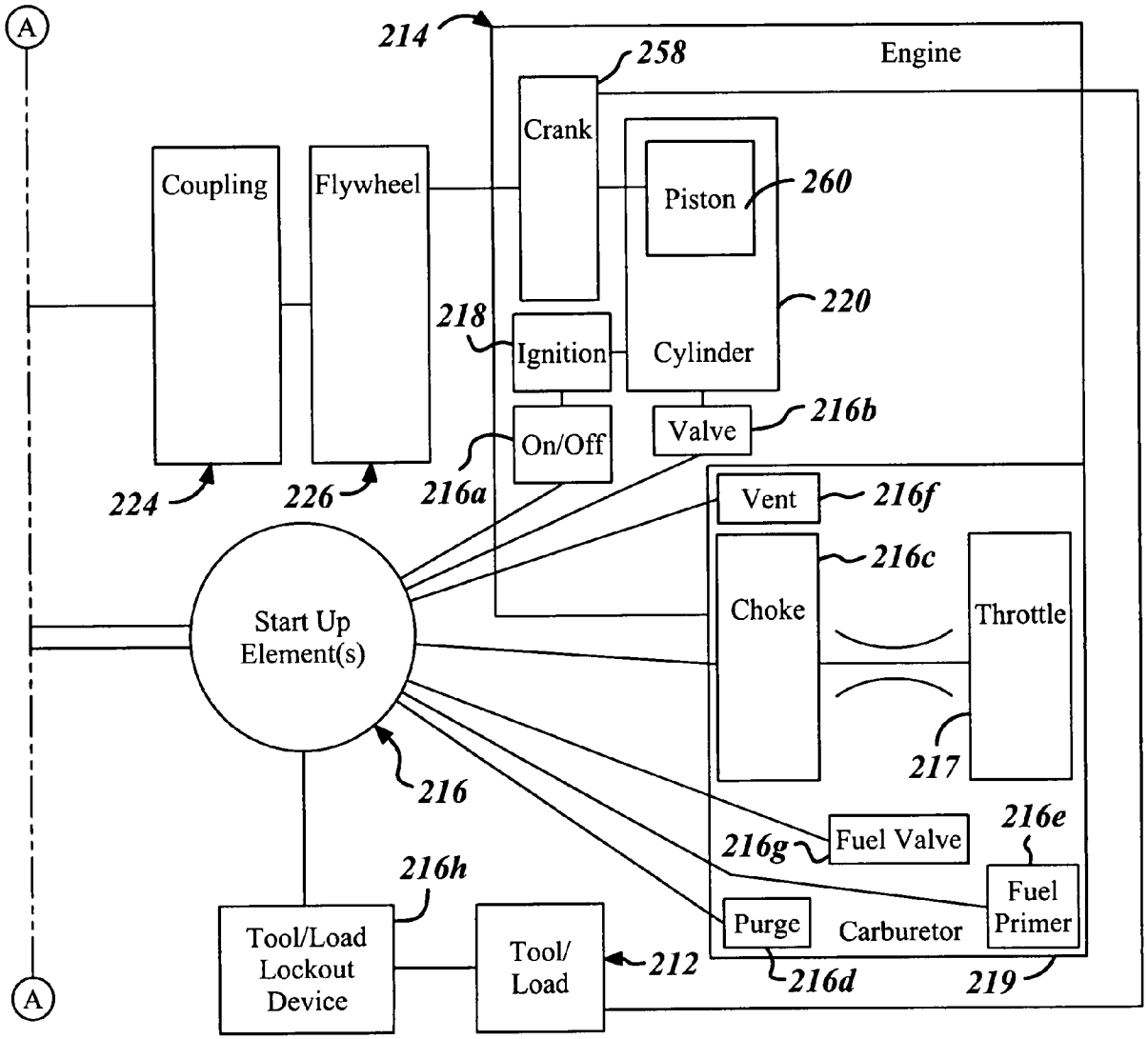

FIGS. 11A and 11B together illustrate a mechanical block diagram of a presently preferred generic embodiment of an engine-powered apparatus 210. The apparatus 210 may be any type of desired apparatus including, but not limited to, a lawnmower, chainsaw, grass trimmer, leaf blower, tractor, a generator, all-terrain vehicle, and the like. The apparatus 210 generally includes an associated tool or load 212 to which the utility of the apparatus 210 is directed and a combustion engine 214 for powering the tool or load 212. The apparatus 210 also includes one or more of various apparatus startup element(s) 216 that will be further described herein below. Finally, the apparatus 210 also includes a pull-starter 222 for manually and mechanically pull-starting the combustion engine 214 of the apparatus 210 via a one-way coupling 224 interposed between the pull-starter 222 and a flywheel 226 of the engine 214. The one-way coupling 224 is preferably a centrifugal coupling, which is known to those of ordinary skill in the art.

The apparatus startup element(s) 216 may include various features that, in and of themselves, are widely known to those of ordinary skill in the art. Such elements 216 may be, but are not limited to, an on/off switch 216*a* for controlling an engine ignition 218 to disable/enable engine operation, an engine startup-assist device like an engine decompression valve 216*b* for relieving pressure within an engine cylinder 220 to relieve pull-start kickback or a choke lever and valve 216*c* for improved cold start performance, an air purge device 216*d* to improve starting by removing unwanted air and stale fuel from the carburetor, a fuel primer device 216*e* to improve starting by injecting a predetermined amount of fuel into the intake passage of the engine, evaporative emission reduction devices like fuel vapor vent valves 216*f* or liquid fuel cutoff valves 216*g* to reduce diurnal fuel emissions, and a tool or load safety lockout device 216*h*, and other like features. Preferably, the start-assist device is a choke valve 216*c* operatively associated with a throttle valve 217 of an engine carburetor 219. A preferred air purge/prime start-assist device is hereby incorporated by reference herein in its entirety as disclosed in U.S. patent application Ser. No. 11/092,532, filed on Mar. 29, 2005 by the assignee hereof and entitled "FUEL SYSTEM PURGE AND STARTER SYSTEM" having an attorney docket number of 628SC [2630.3184.001].

The pull-starter 222 is preferably a modified recoil pulley type of starter and includes a housing 228 that provides structural support for many if not all of the other starter components described herein below. As such, the starter 222 may, but need not, be a self-contained unit that mounts to the rest of the engine-powered apparatus 210. In any case, the housing 228 may be of one-piece construction or may be a sub-assembly, and is a structural member that carries a recoil sheave or pulley 230. Those of ordinary skill in the art will recognize that a recoil biasing element 232 is interposed between the recoil pulley 230 and the housing 228 to rotatably bias the recoil pulley 230 in a circumferential wind up direction. The recoil biasing element 232 is preferably a torsional spring, but any other type of component or device may be used.

The pull-starter 222 also includes a movable dampener device 234 that is preferably carried by the housing 228 for dampening, reducing the maximum variation of, or smoothening the pulling force required to overcome the varying resistance incurred when pull-starting the engine 214. The dampener device 234 includes a shuttle or movable dampener member 236 that is preferably movably mounted to the housing 228 and a dampener biasing member 238 that is interposed between the movable dampener member 236 and the housing 228. Those of ordinary skill in the art will recognize that the dampener member 236 may be an arm(s) or other suitable member(s). The biasing member 238 may include, but is not limited to, a tension or compression spring, a tension or compression elastic member, a viscous dampener member, and other equivalents. A dampener member stop 240 is preferably mounted to, or is an integral part of, the housing 228 or other structural element, for limiting travel of the dampener member 236 to a predetermined stop position.

The dampener device 234 may also be, as shown, a combination dampener and coupling or actuator device for coupling the pull-starter to, and actuating, one or more of the previously discussed apparatus startup element(s) 216 as well as for dampening the pulling action required to start the engine 214. The dampener device 234 is preferably connected to one or more of the startup element(s) 216 wherein the dampener member 236 may be directly connected to the one or more startup element(s) 216 but, as shown, is preferably indirectly connected thereto via an overtravel device 242 that provides lost-motion adjustment. The overtravel device 242 preferably includes a separate overtravel lever or arm 244 that is movably mounted to the dampener member 236, wherein an overtravel biasing element 246 is interposed between the overtravel lever 244 and the dampener member 236 to provide slack-free lost-motion adjustment. The overtravel biasing element 246 may be any type of spring, elastic element, viscous damper, and the like. The dampener device 234 may be connected to the startup element(s) 216 by any desired mechanical connection 247 such as solid linkage, flexible cord or cable, and the like.

Finally, the pull-starter 222 includes a flaccid or flexible member such as a pull-cord 248, cable, rope, or other such equivalent, which has a fixed end 250 attached to the recoil pulley 230. The pull-cord 248 is wound around the pulley 230, routed around or at least over a reaction portion or member 252 of the dampener member 236, fed through the housing 228, and terminates in a handle end 254 attached to a handle 256. The reaction portion or member 252 may be a separate component such as a roller or may be an integral feature of the arm 236. The recoil biasing element 232 keeps the pull-cord 248 normally wound around the recoil pulley 250 and the pull-cord 248 pulled taut such that the handle 256 is urged against the housing 228.

Generic Embodiment—Operation

In operation, an operator or user manually grasps the handle 256 attached to the pull-cord 248 and pulls the pull-cord 248 outward and away from the housing 228. The operator must pull with a force sufficient to overcome the bias force that the recoil pulley biasing element 232 imposes on the recoil pulley 230, and to overcome internal resistance of the engine 214. The internal resistance of the engine 214 includes internal frictional resistance and inertial resistance, as well as compression resistance. The internal frictional resistance is equivalent to a force required to overcome the sum of the static frictional forces of the moving parts of the engine and, likewise, the inertial resistance is equivalent to a force required to overcome the sum of the inertial forces of the moving parts of the engine. The compression resistance is equivalent to the force required to overcome the peak compression cycle pressure in the combustion chamber of the engine.

Under a sufficient initial pulling force, the operator's pull on the pull-cord 248 rotates the pulley 230 in a circumferential unwind direction, opposite of the wind up direction, against the bias force of the recoil biasing element 232 that is engaged between the pulley 230 and the housing 228. In other words, the operator pulls the pull-cord 248 with sufficient strength to overcome the bias force of the recoil pulley biasing element 232 which would otherwise cause the pull-cord 248 to rewind back into the housing 228 over the reaction member 252 of the dampener member 236 and around the pulley 230.

As the pull-cord 248 is pulled outward toward an unwound state, the recoil pulley 230 preferably engages, via the centrifugal coupling 224, the flywheel 228 that is attached to a crankshaft 258 of the engine 214. Under a sufficient continued pulling force, the operator's pull on the pull-cord 248 continues to rotate the pulley 230 to keep overcoming the bias force of the recoil biasing element 232 and additionally overcome the internal resistance of the engine 214, thereby causing one or more engine piston(s) 260 to reciprocate with sufficient speed to allow the engine 214 to start and operate under its own power. Once the engine 214 is running, the one-way coupling 224 between the flywheel 226 and recoil pulley 230 automatically releases so as to avoid damage to the starter 222.

Dampener Operation

But before the engine is running and, thus, the engine is still offering internal resistance to starting, the initial pull of the cord and payout of the cord over the reaction member 252 of the dampener member 236 causes the dampener member 236 to move from its rest position toward its stop 240.

Accordingly, the dampener device 234 cushions the high and/or varying resistance in the pull-cord 248 during pull-starting by pre-loading the pull-cord 248. In the case of a high compression ratio engine or in the case where the engine 214 is otherwise difficult to start because the piston 260 may be in a compression stroke in the cylinder 220 and the like, the cord 248 may be under high tension or may undergo a jerking motion that may make it difficult to properly pull-start the engine 214. Accordingly, by routing the cord 248 over the reaction member 252 of the dampener member 236, a cushioning effect is achieved that significantly diminishes the undesirable jerking motion or initial high resistance. In other words, the dampener device 234 effectively reduces the amount of shock transmitted through the pull-cord 248 to the user by allowing "give" as the engine 214 undergoes its highest resistance at peak compression just before the piston 260 reaches top dead center within the cylinder 220 and by keeping the pull-cord 248 taut by taking up the slack in the pull-cord 248 between compression events or after the engine 214 has started and the pull-starter 222 has effectively been disengaged from the engine 214. Stated yet another way, the pull-starter 222 reduces or modulates harsh transitions in pulling resistance imparted by the engine on the pull-cord 248, both before and after engine startup. The dampener arrangement effectively reduces a differential in pulling force between a minimum pull force and a maximum pull force required to move the piston 260 through the compression cycle, and spreads the differential over a greater time period.

The dampener device 234 also substantially simultaneously actuates the one or more startup element(s) 216 by virtue of the dampener member 236 being at least indirectly connected to the startup element(s) 216. In other words, as the dampener member 236 is displaced by the pull-cord 248 against the bias force of the dampener biasing member 238, the linkage 247 also moves, thereby displacing or actuating the startup element(s) 216. As the dampener member 236 is displaced against the bias force of the biasing member 238 by the movement of the pull-cord 248, the overtravel lever 244 and biasing element 246 also move. In turn, this movement pulls the linkage 247 attached thereto and to the startup element(s) 216, to actuate the startup element(s) 216, such as the butterfly-type choke valve 216*c* from its spring-biased full open position to an actuation position or closed position.

But as soon as the cord 248 is released or as soon as the engine starts, the dampener member 236 is substantially immediately free to move back toward its rest position away from the stop 240, wherein the bias force of the dampener biasing member 238 acts on the dampener member 236 to cause it to reverse direction and move away from the stop 240 and toward its rest position, thereby creating a degree of slack within the Bowden wire or linkage 247. Accordingly, this release of tension within the linkage 247 enables the biasing force of the choke spring to rotate the choke valve 216*c* from its relatively closed position and into an open position or an engine warm-up or partial choke state.

When the engine 214 has been started and the pull-cord 248 is released by the operator, the recoil biasing element 232 causes the pulley 230 to rotate in a wind up direction through a series of complete revolutions. Because the fixed end 250 of the pull-cord 248 is engaged directly to the pulley 230, the cord 248 recoils back into the housing 228 and gets wrapped around the pulley 230 until the handle 256 seats against the housing 228. Also, the bias force of the biasing member 238 acts on the dampener member 236 to return the dampener member 236 to its rest position. Moreover, in the case where the dampener device 234 is attached to a startup element(s) 216, the startup element(s) 216 may have a bias member that imposes a force through the linkage 247 on the dampener member 236 to further urge the dampener member 236 in a direction toward its rest position.

Overtravel Lever Operation

Preferably, the overtravel lever 244 moves relative to the dampener member 236 over a final portion of the travel of dampener member 236. This is particularly preferable where the actuated startup element(s) 216 reach an end-of-travel position before the dampener member 236 hits its stop 240 to reach its end-of-travel position. In such a case, the overtravel device 244 provides slack-free lost-motion adjustment between the dampener member 236 and the startup element(s) 216 to avoid damage to the startup element(s) 216 and/or reduce the need to maintain a precision linkage relationship therebetween.

Momentary Startup Element Operation

In some implementations it may be desirable to ensure that the start assist devices or startup elements 216 are only momentarily actuated. For example, in an implementation where the startup element 216 is the choke valve 216*c*, it is desirable to ensure that the choke valve 216*c* is only momentarily actuated to a closed position for a predetermined desirable period of time or portion of an engine cycle, such as 45-90° of crank revolution as just one example. In other words, it is not desirable to permit the choke valve 216*c* to be kept closed by way of its linkage 247 with the pull-starter 222. Rather, it is desirable to permit the choke valve 216*c* to close momentarily upon pull starting, and automatically open after the pull-cord 248 has initially been pulled regardless of whether the operator immediately releases the pull-cord 248 to permit it to be rewound into its housing 228 or whether the operator continues to grasp the extended pull-cord 248.

When starting an engine, especially a "cold" engine, it is preferable to move the choke valve 216*c* to its fully closed position to appreciably limit air flow through the carburetor 219 and thereby provide a flow of rich fuel-and-air mixture to the engine 214. But if the choke valve 216*c* remains closed after engine startup, then the engine 214 may stall on an overly rich mixture of fuel-and-air or black smoke may be emitted from the engine exhaust indicating an unwanted excessive increase in hydro-carbon emissions. Therefore, to ensure that the choke valve 216*c* does not get stuck or forced closed during pull starting, it is preferred to include the shuttle or dampener biasing element 238 to help release and open the choke valve 216*c*. It is further preferred to provide the dampener biasing element 238 with a biasing force of sufficient magnitude to return the dampener biasing element 238 toward its rest position substantially immediately upon engine startup, i.e. when the engine starts running on its own via internal combustion.

But even with use of the dampener biasing element 238 in the pull-starter 222, if an operator pulls the pull-cord 248 during pull starting of the engine 214 to a completely unwound state such that the pull-cord 248 is fully paid out from the recoil pulley 230, the force of the dampener biasing element 238 could be overcome by the strength of the operator such that the dampener member 236 is not returned to its rest position by the dampener biasing element 238. In other words, upon pull-starting the engine 214, it is not preferred to allow the dampener member 236 to be moved to its fully displaced position and remain there. Rather, it is preferred to enable the dampener member 236 to return to its rest position after an operator has stopped pulling the pull-cord 248 out of the housing from the recoil pulley 230. This ensures that the choke valve 216*c* is only momentarily closed before the engine starts and returns to its open or partially open position to avoid engine flooding. To avoid such a condition it is desirable to suitably size the dampener biasing element 238 and the pull-cord 248 as described below.

It is preferred to provide the length of the pull-cord 248 such that it is not possible for an operator to completely withdraw the pull-cord 248 out of the engine-powered apparatus 210 during normal pull-starting. Normally, when pull-starting the engine-powered apparatus 210, an operator holds onto a portion of the engine-powered apparatus 210 with a first hand and pulls the pull-cord 248 out with a second hand in a direction generally away from the first hand. Accordingly, it is preferred to "size" the length of the pull-cord 248 to prevent an operator from pulling the pull-cord 248 out to such an extent that the pull-cord 248 "bottoms out" wherein the pull-cord 248 no longer pays out of the housing 228 and the pulley 230 no longer rotates because the pull-cord 248 is completely unwound therefrom. Sizing the length of the pull-cord 248 in this manner prevents a condition in which the operator pulls the pull-cord 248 so far as to displace the dampener member 236 against its stop until the operator releases the pull-cord 248.

In one example, a standard length pull-cord of an engine-powered apparatus was lengthened from 46" to 58.5" to ensure that the pull-cord could not be bottomed out by an operator. In any case, it is desirable to ensure that a human having up to a $99^{th}$ percentile fingertip to fingertip "wing-span" or reach cannot bottom out the pull-cord 248. Those of ordinary skill in the art will recognize that the task of specifying a particular length of the pull-cord will vary with each specific engine powered apparatus. In other words, the teaching is application specific and must be determined on a case by case basis. So, regardless of the absolute length of the pull-cord 248, the length of the pull-cord 248 is preferably relatively sized to prevent operators from completely withdrawing the pull-cord 248 during normal two-handed pull-starting of the engine-powered apparatus 210, wherein an operator uses one hand to hold onto a structural portion of the engine-powered apparatus 210 and the other hand to grasp the handle of the pull-cord 248.

It is also preferred to ensure that the force imposed on the pull-cord 248 by the biasing member 238 is sufficient to overcome the force imposed on the pull-cord 248 by the recoil biasing element 232 and overcome the reaction force in the pull-cord 248 offered by the frictional and inertial resistance of the engine 214. In other words, it is preferred to size, or specify the force of, the biasing member 238 such that when the handle end 254 of the pull-cord 248 is relatively stationary, the biasing member 238 is capable of retracting the dampener member 236 against the force imposed on the pull-cord 248 by the recoil biasing element 232, wherein the pull-cord 248 may unwind from the recoil pulley 230 to allow the dampener member 236 to move to its rest position. It is further preferred to size the biasing member 238 such that when an operator pulls on the pull-cord 248, the dampener member 236 tends to remain stationary in conditions where there is no pressure build up during a compression stroke of the engine 214, such as where the engine spark plug has been removed or where an engine compression relief feature is used and, thus, compression resistance is substantially zero.

In other words, when the engine powered apparatus 210 is substantially unloaded and there is relatively little to no compression cycle resistance of the engine 214, the pull-cord 248 may be pulled so as to pay out the pull-cord 248 from the rotating recoil pulley 230 wherein the dampener member 236 remains substantially stationary (allowing for some negligible fluttering of the dampener member 236). Those of ordinary skill in the art will recognize that the task of specifying a particular size of the biasing member 238 will vary with each specific engine powered apparatus. In other words, the teaching is application specific and is determined on a case by case basis for each particular application.

In any case, after the operator has initially pulled the cord 248, the dampener member 236 will move back toward its rest position away from the stop 240, regardless of whether or not the operator has released the handle 36 of the cord 24 or not.

Fifth Modification

FIGS. 12 through 15 illustrate a presently preferred fifth modification of a pull-starter 322. This pull-starter 322 is similar in many respects to the starter 222 of the embodiment of FIGS. 11A and 11B and like numerals between the embodiments generally designate like or corresponding elements throughout the several views of the drawing figures. Additionally, the description of the common subject matter will generally not be repeated here.

Figure 12:
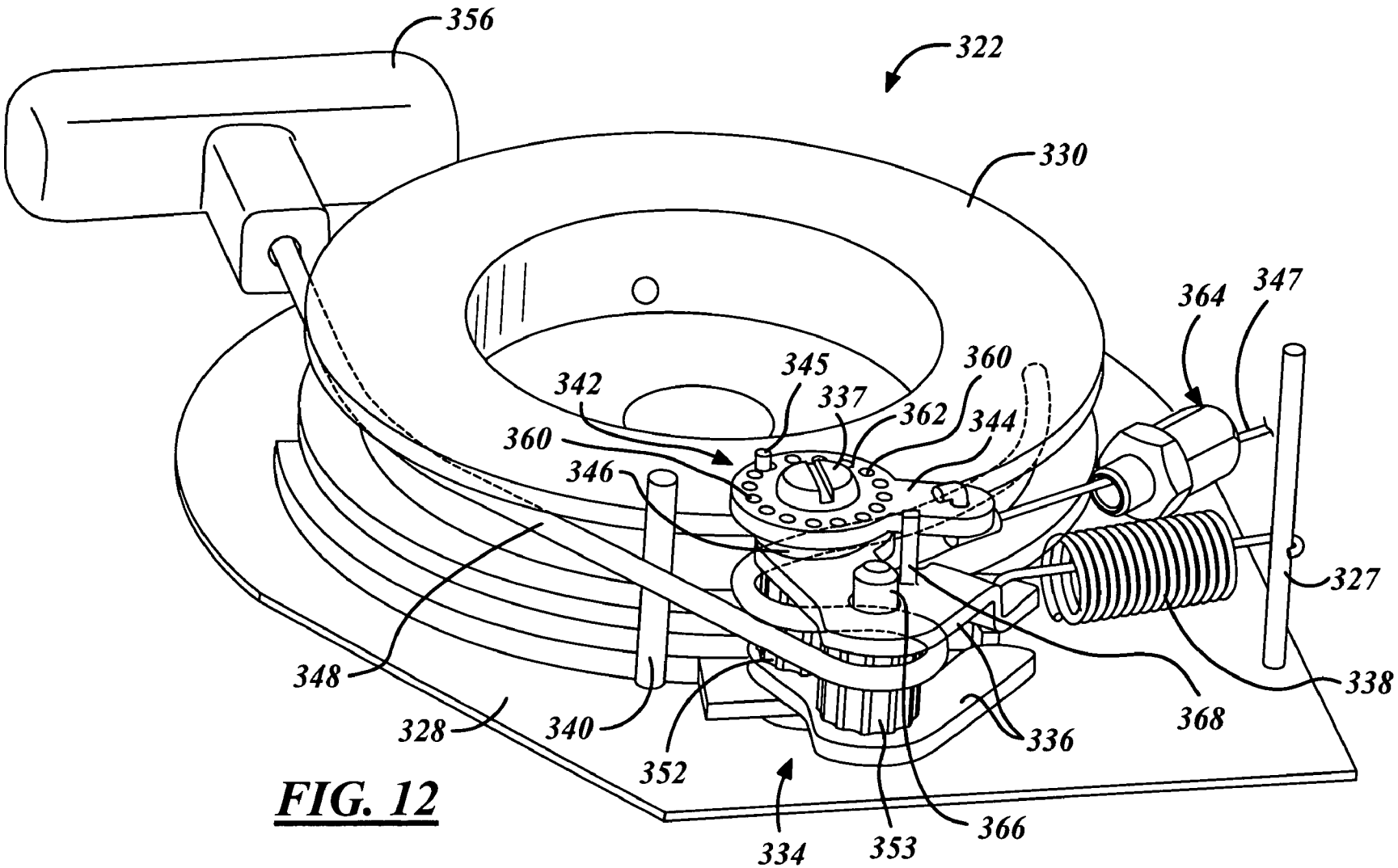
FIG. 12 is a perspective view of a fifth modification of a pull-starter having a pivotable dampener device.

FIG. 12 illustrates a perspective view of the pull-starter 322 that includes a housing 328 (partially shown) which is a structural member that carries a recoil pulley 330. A recoil biasing element (not shown) is interposed between the recoil pulley 330 and the housing 328 to rotatably bias the recoil pulley 330 in a circumferential wind up direction. The pull-starter 322 also includes a dampener device 334 that is also preferably carried by the housing 328.

The dampener device 334 is a combination dampener and actuator device for actuating one or more startup elements (not shown) as well as dampening the pulling action required to start an associated engine (not shown). The dampener device 334 includes a rotatable dampener member 336 that is preferably two plates of stamped or cast metal or durable plastic as shown, and is pivotably mounted to the housing 328 by a pivot screw 337, pin, shaft, or the like. The dampener device 334 also includes a biasing member 338 that is interposed between the rotatable dampener member 336 and a post 327 extending from the housing 328. As shown, the biasing member 338 is a coiled tension spring that is attached to a portion of the dampener member 336 and to the post 327. A dampener member stop 340 is preferably mounted to, or is an integral part of, the housing 328 or other structural element, for limiting travel of the dampener member 336 to a predetermined stop position.

The dampener device 334 is connected to the previously mentioned startup element(s) via an overtravel device 342 that provides lost-motion adjustment between the dampener member 336 and the startup element(s). The overtravel device 342 includes a separate overtravel lever 344 that is preferably of stamped or cast metal or durable plastic construction and is pivotably mounted on the screw 337 for rotation relative to the dampener member 336. An overtravel biasing element or torsional spring 346 is interposed between the overtravel lever 344 and the dampener member 336 to provide slack-free lost-motion adjustment therebetween. The overtravel biasing element 346 is preferably a torsional spring having one end 345 projecting through one of a circumferential array of calibration holes 360 provided around a hub 362 of the overtravel lever 344, and having an opposite end (not shown) engaged against a portion of the dampener member 336. The overtravel lever 344 of the dampener device 334 is connected to the startup element(s) by a flexible push-pull cable 347, such as a Bowden cable assembly, and is preferably equipped with an adjustment device 364 as shown. The adjustment device 364 may be mounted to any portion of the housing 328 or any other desired structural member of an engine-powered apparatus.

The pull-starter 322 also includes a pull-cord 348, which has a fixed end (not shown) attached to the recoil pulley 330. The pull-cord 348 is wound around the pulley 330, routed first over a first reaction member 352 of the dampener member 336 and then routed over a second reaction member 353 of the dampener member 336 to reverse direction. The reaction members 352, 353 are preferably cogged rollers composed of nylon, Delrin®, or the like. The first reaction member 352 is rotatably mounted by the pivot screw 337 between the two plates of the dampener member 336, and the second reaction member 353 is rotatably mounted by a post 366 extending between the plates of the dampener member 336. Preferably, the post 366 is fixed to or an integral part of one of the plates of the dampener member 336 and extends through the other plate of the dampener member 336 to retain the plates of the dampener member 336 against relative rotation therebetween. The pull-cord 348 extends from the second reaction roller 353 of the dampener device 334 and is routed through the housing 328, and terminates in a handle end (not shown) attached to a handle 356, external of the housing 328.

Figure 13:
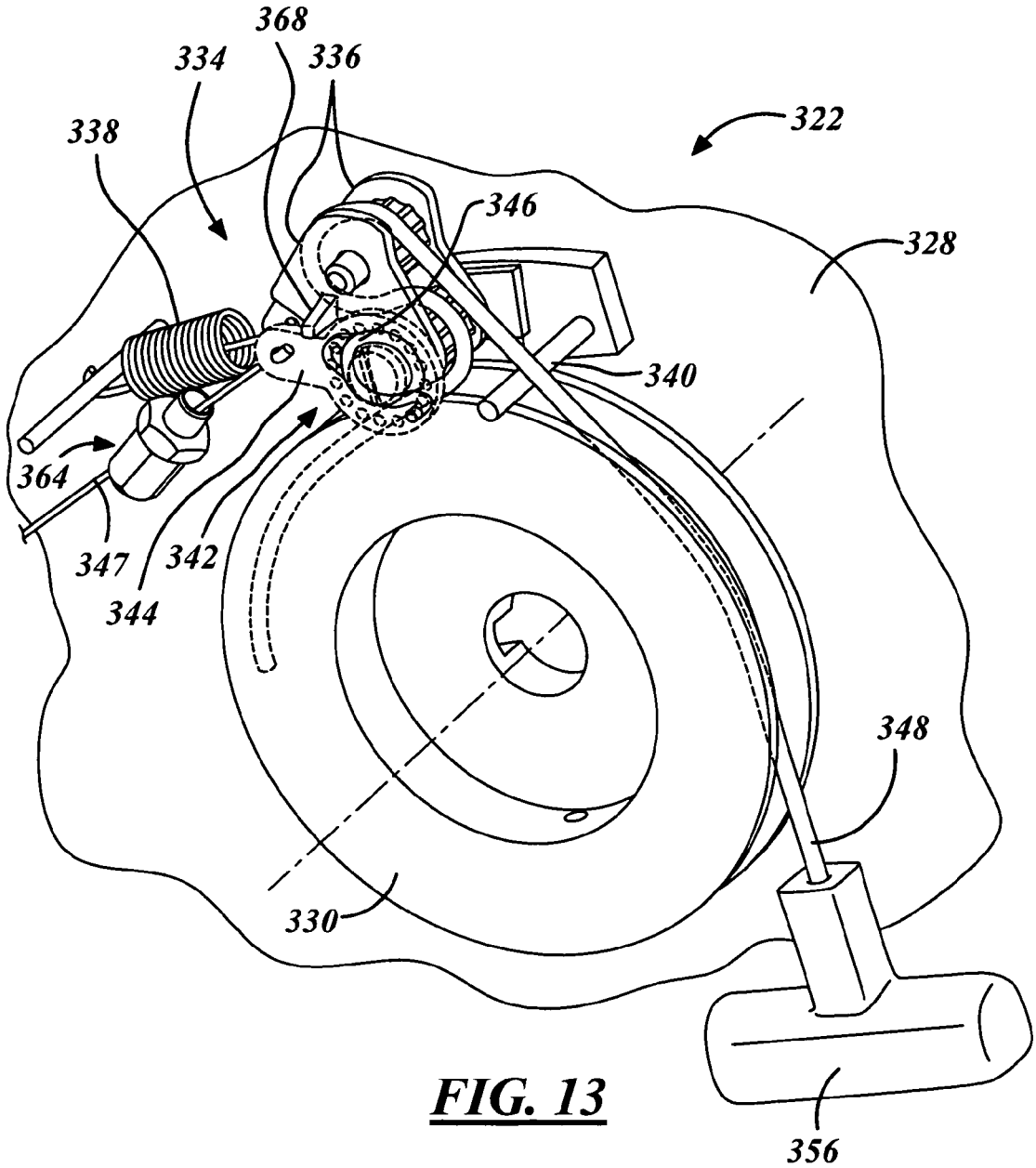
FIG. 13 is a perspective view of the pull-starter of FIG. 12, showing the pivotable dampener device in its rest position.
Figure 15:
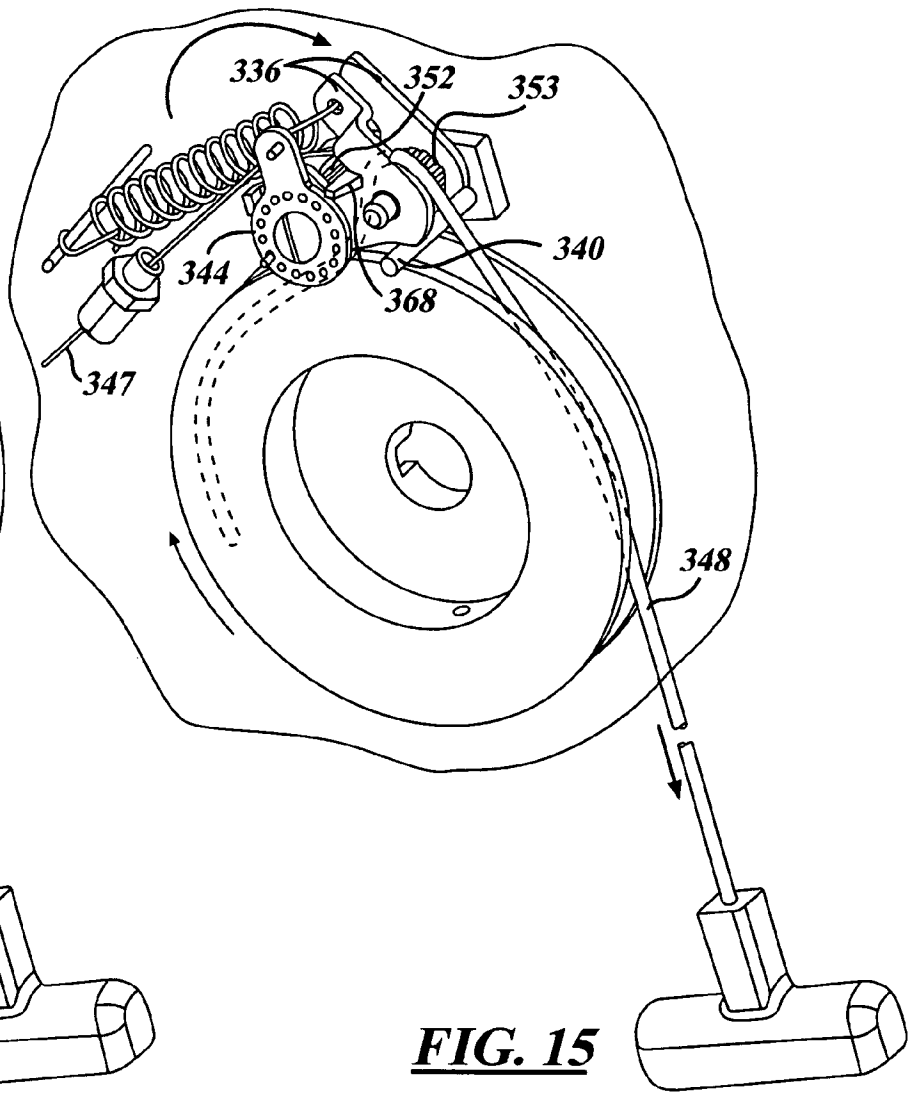
FIG. 15 is a perspective view of the pull-starter of FIG. 12, showing the pivotable dampener device fully pivoted to a stop position.
Figure 14:
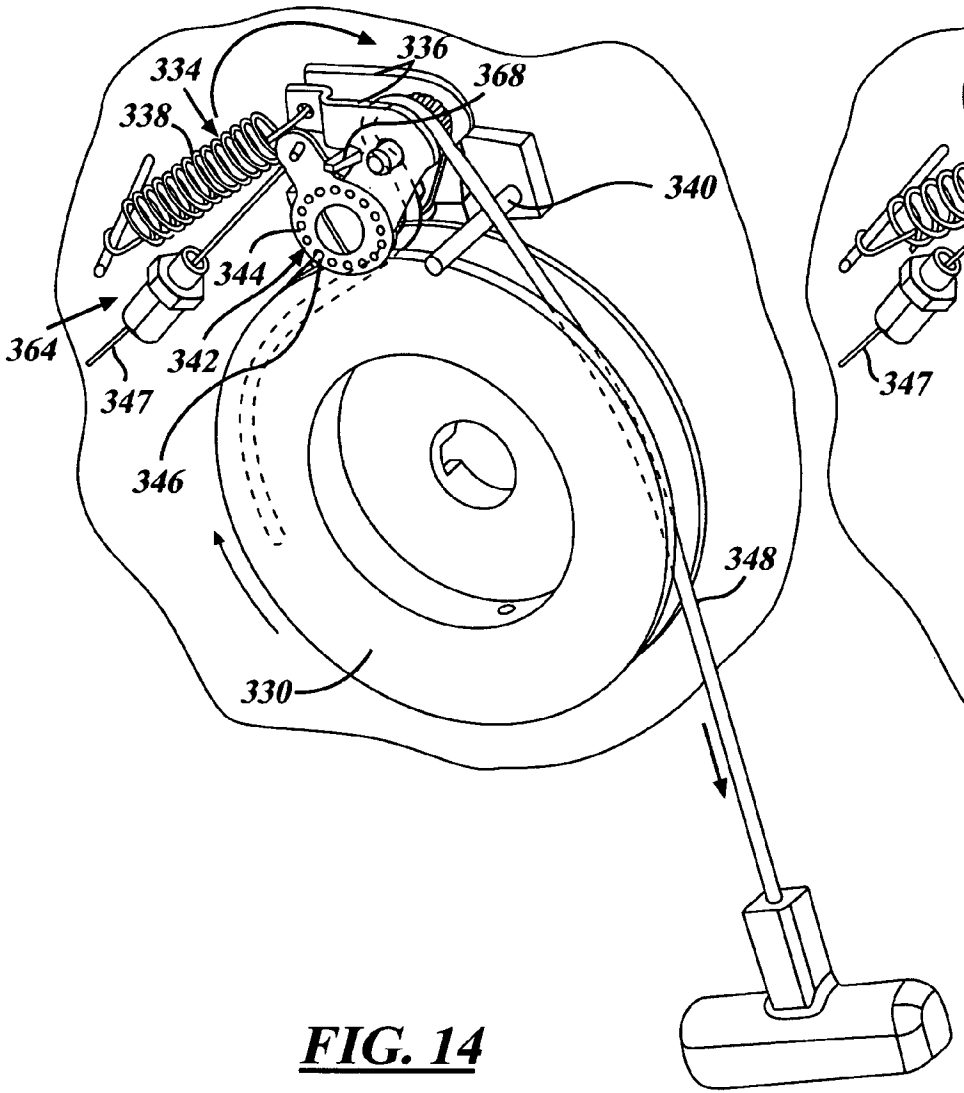
FIG. 14 is a perspective view of the pull-starter of FIG. 12, showing the pivotable dampener device pivoted from its rest position.

The operation of the starter is illustrated by FIGS. 13 through 15. In FIG. 13, the starter 322 is shown in a state of rest wherein the dampener spring 338 maintains the dampener member 336 in an initial or rest position. In turn, an overtravel stop or projection 368 on the dampener member 336 maintains the overtravel arm 344 in its initial or rest position. From this initial state of rest, an operator manually grasps the handle 356 attached to the pull-cord 348 and pulls the pull-cord 348.

As shown in FIG. 14, under typical circumstances the pulling action on the pull cord 348 begins to pivot the dampener member 336 of the dampener device 334 toward the stop 340 and against the bias force of the dampener spring 338 to cushion high and/or varying resistance imposed on the pull-cord 348 by the engine, and substantially simultaneously begins to rotate the pulley 330 in a circumferential unwind direction to start the engine (not shown). Moreover, the dampener device 334 also substantially simultaneously actuates the engine-powered apparatus startup element(s), when the pull cord 348 pivots the dampener member 336, which rotates the overtravel spring 346, to thereby rotate the overtravel arm 344. Accordingly, the rotation of the overtravel arm 344 causes the push-pull cable 347 to move and, in turn, actuates the attached startup element(s).

As shown in FIG. 15, the overtravel lever 344 is movable relative to the dampener member 336 over a final portion of the travel of dampener member 336 to provide lost-motion adjustment between the dampener member 336 and the startup element(s). Here, the dampener device 334 has been fully pivoted against its stop 340 and has rotated relative to the overtravel arm 344, which is no longer seated against the overtravel projection 368. Such relative movement avoids over-extension of the push-pull cable 347 to eliminate damage to the attached startup element(s) and avoids the need to maintain an unnecessarily precise movable relationship between the dampener member 336 and the startup element(s).

In the case where the startup element is a choke valve, the overtravel spring 346 is preferably sized such that it is able to overcome the force of a choke valve return spring.

Sixth Modification

Figure 17:
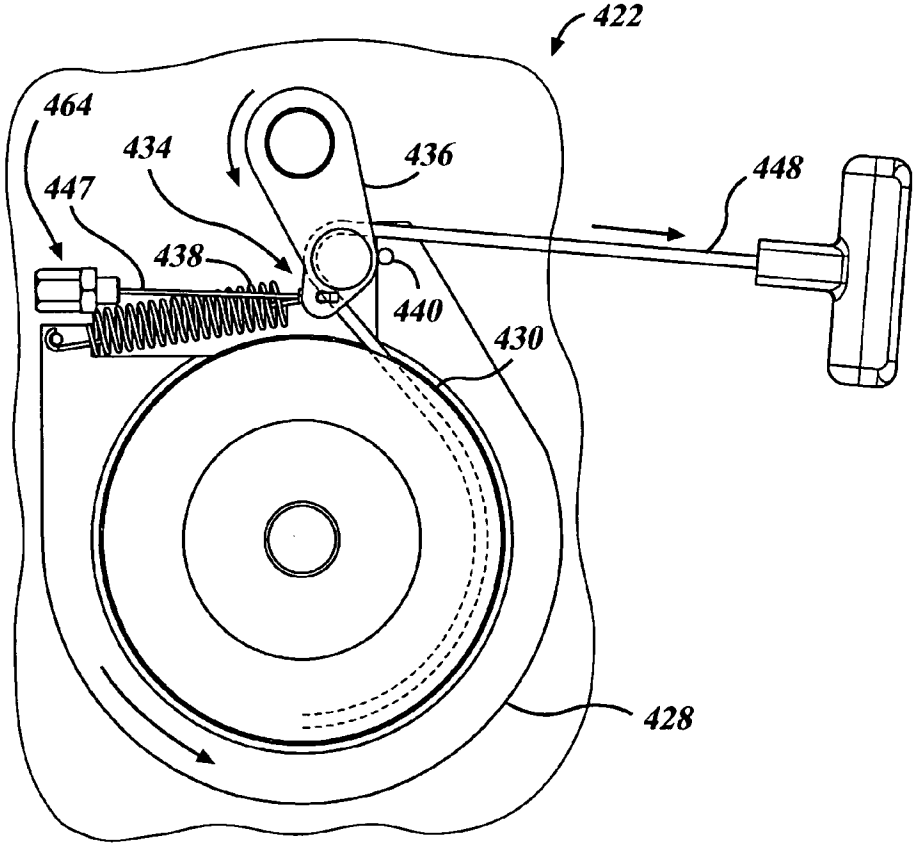
FIG. 17 is a plan view of the pull-starter of FIG. 16, showing the pivotable dampener device fully pivoted to a stop position.
Figure 16:
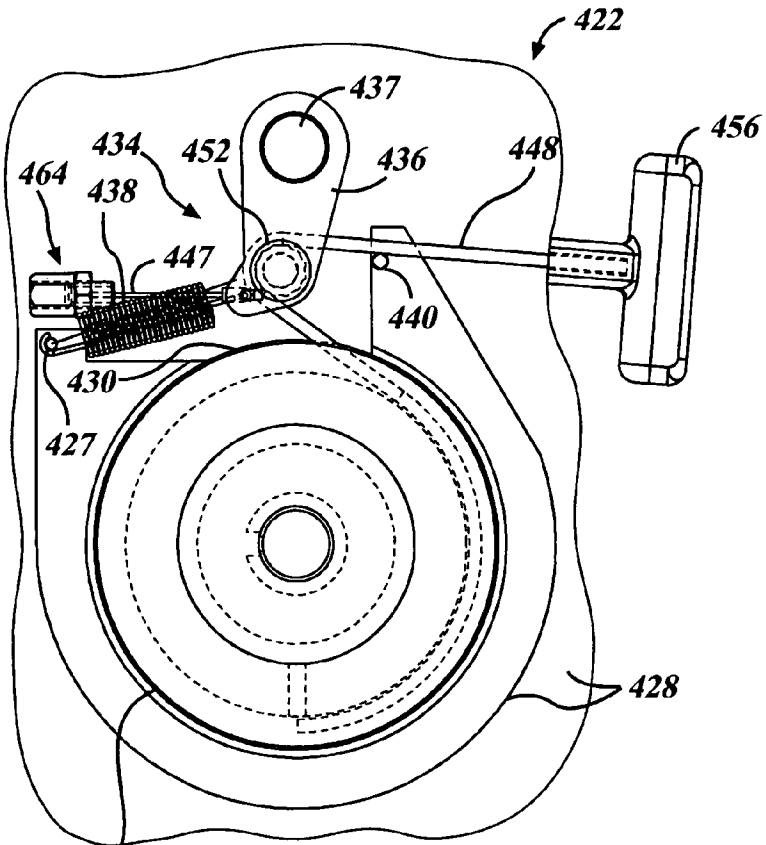
FIG. 16 is a plan view of a sixth modification of a pull-starter, showing a pivotable dampener device in a rest position.

FIGS. 16 and 17 illustrate a presently preferred sixth modification of a pull-starter 422. This pull-starter 422 is similar in many respects to the starters 222, 322 of the previous forms of FIGS. 11A through 15, and like numerals between the various forms generally designate like or corresponding elements throughout the several views of the drawing figures. Additionally, the description of the common subject matter will generally not be repeated here.

FIG. 16 illustrates a plan view of the pull-starter 422 that includes a housing 428 (partially shown), which is a structural member that carries a recoil pulley 430. A recoil biasing element (not shown) is interposed between the recoil pulley 430 and the housing 428 to rotatably bias the recoil pulley 430 in a circumferential wind up direction. The pull-starter 422 also includes a dampener device 434 that is preferably carried by the housing 428.

The dampener device 434 is a combination dampener and actuator device for actuating one or more startup elements (not shown) as well as for dampening the pulling action required to start an associated engine (not shown). The dampener device 434 includes a rotatable dampener member 436 that is preferably pivotably mounted to the housing 428 by a pivot shaft 437 through one end of the arm 436 in a location radially outboard of the outer diameter of the pulley 430. The dampener device 434 also includes a biasing member or coiled tension spring 438 that is interposed between one end of the pivotable dampener member 436 and a post 427 fixed to and extending from the housing 428. A dampener member stop 440 is preferably fixed to, or is an integral part of, the housing 428 or other structural element, for limiting travel of the dampener member 436 to a predetermined stop position. The dampener device 434 is connected to the previously mentioned startup element(s) through a push-pull cable 447 and adjustment device 464.

The pull-starter 422 also includes a pull-cord 448, which has a fixed end (not shown) attached to the recoil pulley 430. The pull-cord 448 is wound around the pulley 430, and routed over a reaction roller 452 of the dampener member 436. The reaction roller 452 is rotatably mounted on the dampener member 436 in a location between the pivot shaft 437 and the outer diameter of the pulley 430. The pull-cord 448 extends from the dampener device 434 and is routed through the housing 428, and terminates in a handle end (not shown) attached to a handle 456.

The operation of the starter 422 is illustrated by FIG. 17. Under typical circumstances, the pulling action on the pull cord 448 pivots the dampener member 436 of the dampener device 434 toward the stop 440 against the bias force of the dampener spring 438 to cushion high and/or varying resistance imposed on the pull-cord 448 by the engine and substantially simultaneously rotates the pulley 430 in a circumferential unwind direction to start the engine (not shown). Moreover, the dampener device 434 also substantially simultaneously actuates the engine-powered apparatus startup element(s). The pull cord 448 pivots the dampener member 436, which causes the push-pull cable 447 to move and, in turn, actuates the attached startup element(s).

Seventh Modification

Figure 19:
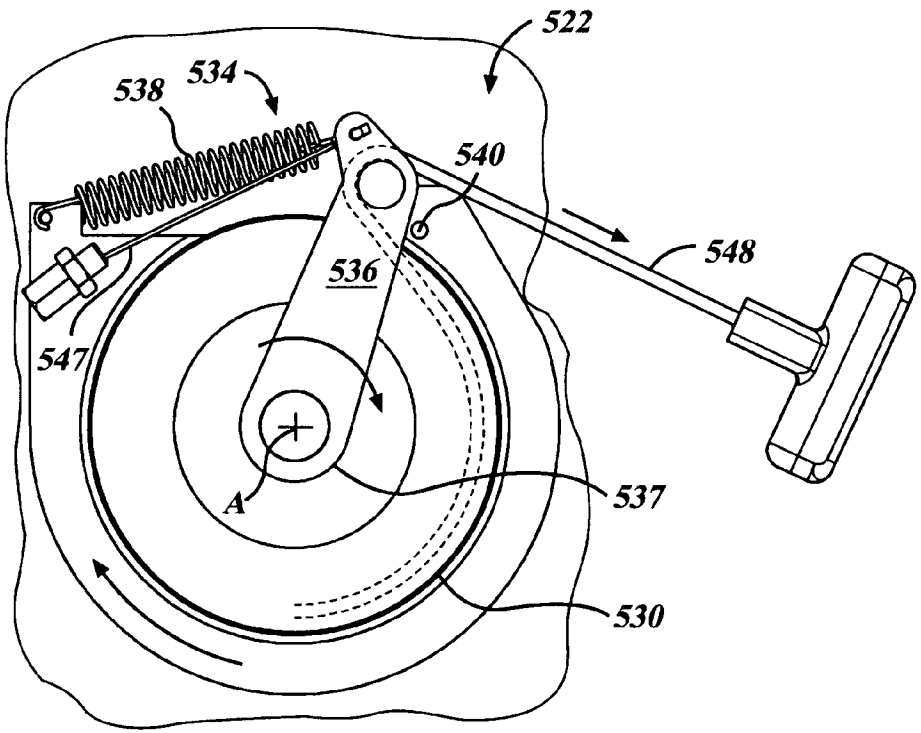
FIG. 19 is a plan view of the pull-starter of FIG. 18, showing the pivotable dampener device fully pivoted to a stop position.
Figure 18:
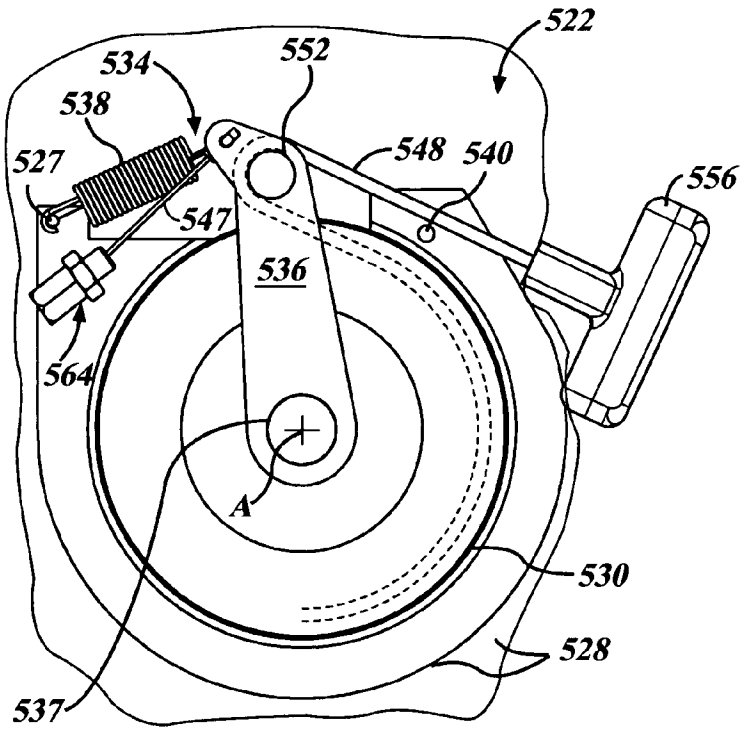
FIG. 18 is a plan view of an seventh modification of a pull-starter, showing a pivotable dampener device in a rest position.

FIGS. 18 and 19 illustrate a presently preferred seventh modification of a pull-starter 522. This embodiment is similar in many respects to the starters 222, 322, and 422 of the previous forms of FIGS. 11A through 17, and like numerals between the various forms generally designate like or corresponding elements throughout the several views of the drawing figures. Additionally, the description of the common subject matter will generally not be repeated here.

FIG. 18 illustrates a plan view of the pull-starter 522 that includes a housing 528 (partially shown), which rotatably carries a recoil pulley 530. A recoil biasing element (not shown) is interposed between the recoil pulley 530 and the housing 528 to rotatably bias the recoil pulley 530 in a circumferential wind up direction. The pull-starter 522 also includes a dampener device 534 that is preferably carried by the housing 528.

The dampener device 534 is a combination dampener and actuator device for actuating one or more startup elements (not shown) as well as dampening the pulling action required to start an associated engine (not shown). The dampener device 534 includes a rotatable dampener member 536 that is preferably pivotably mounted on the housing 528 by a pivot shaft 537 through one end of the arm 536 and in a location substantially coaxial with a rotational axis A of the pulley 530. The dampener device 534 also includes a biasing member or coiled tension spring 538 that is interposed between one end of the pivotable dampener member 536 and a post 527 extending from the housing 528. A dampener member stop 540 limits travel of the dampener member 536 to a predetermined stop position. The dampener device 534 is connected to the previously mentioned startup element(s) via a push-pull cable 547 and adjustment device 564.

The pull-starter 522 also includes a pull-cord 548, which has a fixed end (not shown) attached to the recoil pulley 530. The pull-cord 548 is wound around the pulley 530, and routed over a reaction roller 552 of the dampener member 536. The reaction roller 552 is rotatably mounted to the dampener member 536 radially outward of the outer diameter of the pulley 530. The pull-cord 548 extends from the dampener device 534 and is routed through the housing 528, and terminates in a handle end (not shown) attached to a handle 556.

The operation of the starter 522 is illustrated by FIG. 19. Under typical circumstances, the pulling action on the pull cord 548 pivots the dampener member 536 of the dampener device 534 toward the stop 540 against the bias force of the dampener spring 538 and substantially simultaneously rotates the pulley 530 in a circumferential unwind direction to start the engine (not shown). Moreover, the dampener device 534 also substantially simultaneously actuates the engine-powered apparatus startup element(s). The pull cord 548 pivots the dampener member 536, which causes the push-pull cable 547 to move and, in turn, actuates the attached startup element(s).

Eighth Modification

Figure 21:
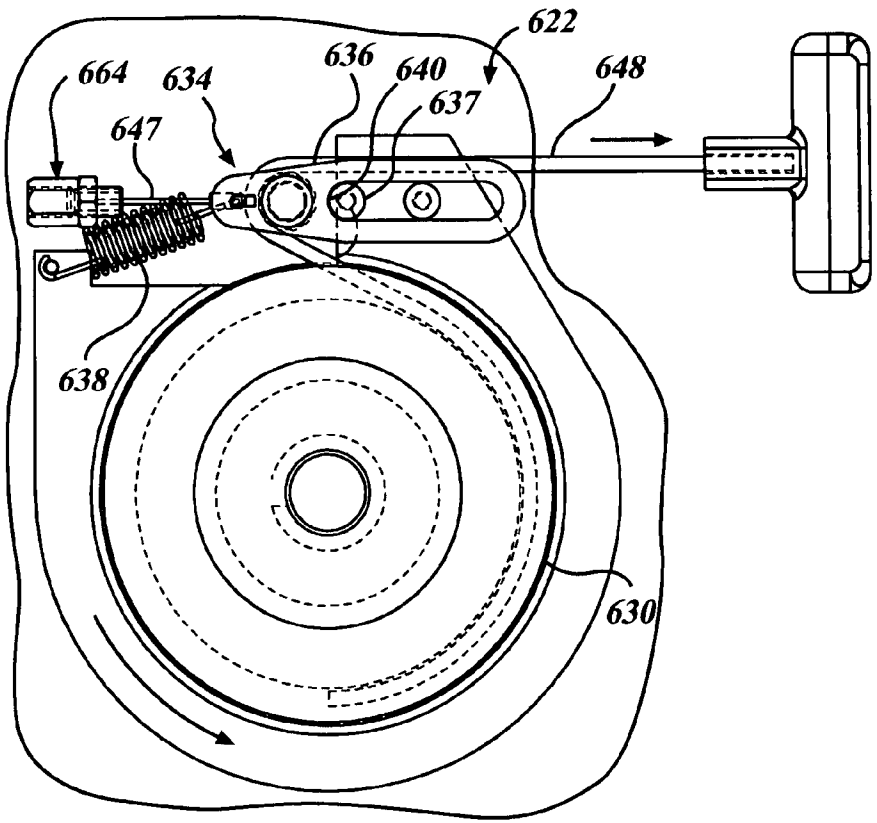
FIG. 21 is a plan view of the pull-starter of FIG. 20, showing the translatable dampener device fully translated to a stop position.
Figure 20:
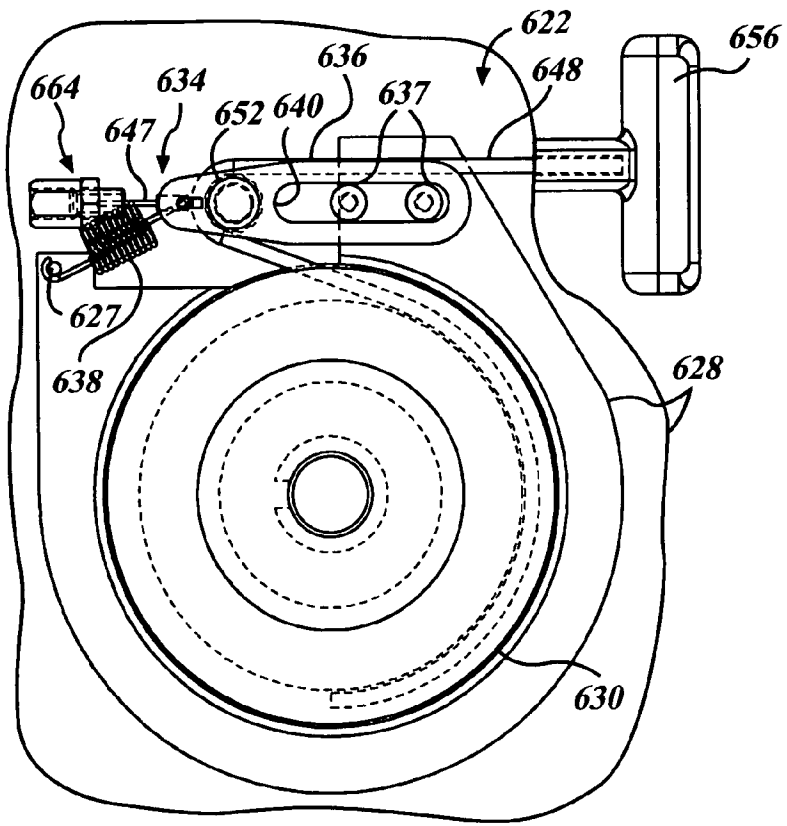
FIG. 20 is a plan view of a eighth modification of a pull-starter, showing a translatable dampener device in a rest position.

FIGS. 20 and 21 illustrate a presently preferred eighth modification of a pull-starter 622. This pull-starter 622 is similar in many respects to the starters 222, 322, 422, and 522 of the previous forms of FIGS. 11A through 19, and like numerals between the various forms generally designate like or corresponding elements throughout the several views of the drawing figures. Additionally, the description of the common subject matter will generally not be repeated here.

FIG. 20 illustrates a plan view of the pull-starter 622 that includes a housing 628 (partially shown) that rotatably carries a recoil pulley 630. A recoil biasing element (not shown) is interposed between the recoil pulley 630 and the housing 628 to rotatably bias the recoil pulley 630 in a circumferential wind up direction. The pull-starter 622 also includes a dampener device 634 that is preferably carried by the housing 628.

The dampener device 634 is a combination dampener and actuator device for actuating one or more startup elements (not shown) as well as dampening the pulling action required to start an associated engine (not shown). The dampener device 634 includes a linearly displaceable or translatable dampener member 636 that is preferably mounted to the housing 628 by guide rollers 637 in a location radially outward of the outer diameter of the pulley 630. The dampener device 634 also includes a biasing member or coiled tension spring 638 that is interposed between one end of the pivotable dampener member 636 and a post 627 extending from the housing 628. One end of a slot 640 in the dampener member engages one of the guide rollers 637 to act as a stop for limiting travel of the dampener member 636 to a predetermined stop position. The dampener device 634 is connected to the previously mentioned startup element(s) through a push-pull cable 647 and adjustment device 664.

The pull-starter 622 also includes a pull-cord 648, which has a fixed end (not shown) attached to the recoil pulley 630. The pull-cord 648 is wound around the pulley 630, and routed over a reaction roller 652 of the dampener member 636. The reaction roller 652 is rotatably mounted to the dampener member 636 in a location radially outward of the outer diameter of the pulley 630. The pull-cord 648 extends from the dampener device 634 and is routed through the housing 628, and terminates in a handle end (not shown) attached to a handle 656.

The operation of the starter 622 is illustrated by FIG. 21. Under typical circumstances, the pulling action on the pull cord 648 translates or displaces the dampener member 636 of the dampener device 634 against the bias force of the dampener spring 638 until one end of the slot 640 engages one of the guide rollers 637, and substantially simultaneously rotates the pulley 630 in a circumferential unwind direction to start the engine (not shown). Moreover, the dampener device 634 also substantially simultaneously actuates the engine-powered apparatus startup elements(s). The pull cord 648 linearly displaces the dampener member 636, which causes the push-pull cable 647 to move and, in turn, actuates the attached startup element(s).

The descriptions of all of the above-described embodiments and modified forms are incorporated by reference into one another.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and the various changes may be made without departing from the spirit or scope of the invention as defined by the following claims.

The invention claimed is:

1. A pull-cord start system for a combustion engine comprising:

an engine start assist device;

a housing;

a recoil pulley disposed rotatably in the housing and connected to a crankshaft of the engine;

a coupling disposed in part in the housing and constructed and arranged to interact with the recoil pulley;

a linkage operably connecting the coupling with the start assist device;

a cord having a first and last winding wound about the recoil pulley, a first end adjacent the first winding for gripping by an operator, and a second end adjacent the last winding and engaged to the pulley;

wherein unwinding of the first winding by a manual pull of the cord by the operator causes the recoil pulley to rotate and the coupling to move relative to the housing which actuates the start assist device;

a circumferential surface of the recoil pulley;

a groove of the recoil pulley opened radially outward for receiving the cord;

a channel defined radially between the housing and the circumferential surface; and wherein the coupling is disposed in part in the channel.

2. The pull-cord start system set forth in claim 1 wherein the start assist device is a carburetor having a choke valve and a throttle valve.

3. The pull-cord start system set forth in claim 2 comprising:

the choke valve of the carburetor is connected to the linkage; and wherein the coupling drives the linkage upon initial pulling of the cord which causes the choke valve to close and the choke valve closure to partially open the throttle valve.

4. The pull-cord start system set forth in claim 1 wherein the start assist device is a pressure relief valve which communicates with a combustion chamber of the engine.

5. The pull-cord start system set forth in claim 1 comprising:

the recoil pulley having a recoiled state, an unwound state and a central axis;

a shuttle of the coupling disposed slidably in the channel; and wherein the linkage is connected to the shuttle.

6. The pull-cord start system set forth in claim 1 wherein the start assist device comprises:

a carburetor having a fuel-and-air mixing passage;

a rotatable choke valve in the fuel-and-air mixing passage and yieldably biased to an open position;

a rotatable throttle valve in the fuel-and-air mixing passage downstream of the choke valve and yieldably biased to an idle position and away from a fast-idle position;

the linkage being operably connected to the choke valve to rotate the choke valve toward a closed position from the biased open position when the coupling moves toward an actuated state upon pulling of the cord; and release of the cord causes the coupling to move out of the actuated state and the choke valve to automatically move at least partially toward the biased open position.

7. The pull-cord start system set forth in claim 6 wherein release of the cord causes the coupling to move out of the actuated state and the choke valve to automatically move from the closed position to a partial choke state.

8. The pull-cord start system set forth in claim 6 further comprising a cam linkage of the carburetor connecting the choke valve to the throttle valve and constructed and arranged to prevent the choke valve from completely rotating into the biased open position and prevent the throttle valve from completely rotating into the biased idle position when the pull cord is released.

9. The pull-cord start system set forth in claim 8 further comprising:

a shaft of the choke valve extending laterally through the fuel-and-air mixing passage and rotatably carried by the body;

a member of the cam linkage projecting radially outward from the rotating shaft of the choke valve, the member carrying a cam surface;

a shaft of the throttle valve extending laterally through the fuel-and-air mixing passage and rotatably carried by the body;

a lever of the cain linkage projecting radially outward from the rotating shaft of the throttle valve, the lever carrying a contact face that contacts the cam surface;

a tab projecting radially outward from the cam surface wherein the tab contacts the lever as the choke valve automatically rotates from the closed position to a warm-up state when the cord is released;

an arm projecting radially outward from the shaft of the choke valve, the arm having a distal end connected to the linkage for rotation of the choke valve; and wherein the throttle valve slightly closes automatically as the choke valve rotates from the closed position and at least partially toward the open position when the cord is released.

10. The pull-cord start system set forth in claim 9 wherein the throttle valve slightly closes automatically rotating from the cold-start position to a fast idle position as the choke valve rotates from the closed position to the warm-up state when the cord is released.

11. A pull-cord system for a combustion engine comprising:

an engine start assist device;

a housing;

a recoil pulley disposed rotatably in the housing and connected to a crankshaft of the engine;

a coupling disposed in part in the housing and constructed and arranged to interact with the recoil pulley;

a linkage operably connecting the coupling with the start assist device;

a cord having a first and last winding wound about the recoil pulley, a first end adjacent the first winding for gripping by an operator, and a second end adjacent the last winding and engaged to the pulley;

wherein unwinding of the first winding by a manual pull of the cord by the operator causes the recoil pulley to rotate and the coupling to move relative to the housing which actuates the start assist device;

a circumferential surface of the recoil pulley;

a groove of the recoil pulley opened radially outward for receiving the cord;

a channel defined radially between the housing and the circumferential surface;

wherein the coupling is disposed in part in the channel;

the recoil pulley having a recoiled state, an unwound state and a central axis;

a shuttle of the coupling disposed slidably in the channel;

wherein the linkage is connected to the shuttle;

a roller of the coupling engaged rotatably to the shuttle within the channel, the roller having a rotational axis disposed parallel to the central axis and disposed radially outward of the recoil pulley;

wherein the first winding of the cord is wound over the roller and the recoil pulley and the last winding is wound only about the recoil pulley when the recoil pulley is in the recoiled state; and wherein the first winding is withdrawn from the housing and the last winding is generally wound over the roller when the recoil pulley is in the unwound state.

12. The pull-cord start system set forth in claim 11 comprising:

a stop carried by the housing and defining a first end of the channel; and wherein the shuttle contacts the stop as the cord is withdrawn from the housing.

13. The pull-cord start system set forth in claim 12 comprising:

a recoil stop carried by the housing and defining a second end of the channel; and wherein the shuttle contacts the recoil stop as the pulley recoils and the cord rewinds back into the housing.

14. The pull-cord start system set forth in claim 13 comprising a radially inward facing surface of the shuttle being in releasable frictional engagement with the circumferential surface of the recoil pulley as the shuttle moves circumferentially between the pull and recoil stops.

15. The pull-cord start system set forth in claim 13 comprising a plurality of friction reducing wheels disposed between the shuttle and the recoil pulley.

16. The pull-cord start system set forth in claim 15 wherein the plurality of wheels are engaged rotatably to the shuttle and ride upon the circumferential surface of the pulley.

17. The pull-cord start system set forth in claim 13 comprising a plurality of bearings disposed between the shuttle and the recoil pulley.

18. The pull-cord start system set forth in claim 13 comprising:

a shaft disposed concentrically to the central axis;

a radially extending plate engaged to the shuttle and attached rotatably to the shaft; and wherein the shuttle is spaced radially from the recoil pulley.

19. A pull-cord start system for a combustion engine comprising:

a start assist device having an actuated position and a normal operating yieldably biased position;

a housing;

a recoil pulley disposed rotatably in the housing and connected by a one-way coupling to a crankshaft of the engine, the recoil pulley having a central axis, a yieldably biased recoiled state and an unwound state;

a shuttle in operable relationship with the recoil pulley, the shuttle having an actuation position;

a linkage operably connected to the shuttle and the start assist device;

a cord having a first and last winding wound about the recoil pulley, a first end adjacent the first winding for gripping by an operator, and a second end adjacent the last winding and engaged to the pulley;

a roller engaged rotatably to the shuttle about a rotational axis disposed parallel to the central axis of the recoil pulley;

the first winding of the cord is wound over the roller and the recoil pulley and generally encircles both the central axis and the rotational axis, and the last winding is wound about only the recoil pulley so that the rotational axis is located radially outside of the last winding when the recoil pulley is in the recoiled state; and the last winding of the cord is substantially wound over the roller and the recoil pulley and the first winding is disposed outside of the housing when the recoil pulley is in the unwound state.

20. The pull-cord start system set forth in claim 19 wherein unwinding of the first winding by a manual pull of the cord by the operator causes the recoil pulley to rotate and the shuttle to move into the actuation state which moves the start assist device into the actuation position via the linkage.

21. The pull-cord start system set forth in claim 20 wherein the shuttle remains in the actuation position as the cord is being pulled by the operator and when the recoil pulley is in the unwound state.

22. A pull-cord start system for a combustion engine comprising:

an engine start assist device;

a housing;

a recoil pulley disposed rotatably in the housing about a central axis and connected to a crankshaft of the engine;

a shuttle disposed in part in the housing and constructed and arranged to interact with the recoil pulley while moving circumferentially with respect to the central axis;

a linkage operably connecting the shuttle with the start assist device;

a cord having a first and last winding wound about the recoil pulley, a first end adjacent the first winding for gripping by an operator, and a second end adjacent the last winding and engaged to the pulley; and wherein unwinding of the first winding by a manual pull of the cord by the operator causes the recoil pulley to rotate and the shuttle to move relative to the housing which actuates the start assist device.

23. The pull-cord start system set forth in claim 22 further comprising:

a circumferential surface of the recoil pulley;

a groove of the recoil pulley opened radially outward for receiving the cord; and a channel defined radially between the housing and the circumferential surface and substantially aligned axially to the groove and with respect to the central axis and the coupling being disposed in part in the channel.

24. A pull cord start system for a combustion engine comprising:

a carburetor having:

a body, a fuel-and-air mixing passage through the body, a rotatable choke valve in the fuel-and-air mixing passage and biased yieldably in an open position, and a rotatable throttle valve in the fuel-and-air mixing passage downstream of the choke valve and biased yieldably in a closing direction;

a pull-cord assembly having:

a housing, a recoil pulley disposed rotatably in the housing and connected to a crankshaft of the engine, a coupling disposed at least in part in the housing and constructed and arranged to interact with the recoil pulley, and a cord having a first and last winding wound about the recoil pulley, a first end adjacent the first winding for gripping by an operator, and a second end adjacent the last winding and engaged to the pulley so that pulling of the cord causes the coupling to move toward an actuated state; and a linkage operably connecting the coupling of the pull-cord assembly with the choke valve of the carburetor so that when the coupling is moving toward the actuated state the linkage moves the choke valve toward a closed position from the biased open position, and release of the cord de-actuates the coupling causing the choke valve to move partially toward the biased closed position.

25. The pull cord start system set forth in claim 24 further comprising a cam linkage of the carburetor connecting the choke valve to the throttle valve and constructed and arranged to prevent the choke valve from completely rotating into the biased open position and limiting biased rotation of the throttle valve toward a closing direction when the pull cord is released.

26. The pull cord start system set forth in claim 25 further comprising:

a shaft of the choke valve extending laterally through the fuel-and-air mixing passage and rotatably carried by the body;

a member of the cam linkage projecting radially outward from the shaft of the choke valve, the member carrying a cam surface;

a shaft of the throttle valve extending laterally through the fuel-and-air mixing passage and rotatably carried by the body; and a lever of the cam linkage projecting radially outward from the shaft of the throttle valve, the lever carrying a contact face that contacts the cam surface.

27. The pull cord start system set forth in claim 26 further comprising a tab projecting radially outward from the cam surface wherein the tab contacts the lever as the biased open choke valve automatically rotates from the closed position to a warm-up state when the cord is released.

28. The pull cord start system set forth in claim 27 wherein the biased throttle valve slightly closes automatically rotating from a cold-start position to an engine warm-up position as the choke valve rotates from the closed position to the warm-up state when the cord is released.

29. A pull-starter adapted to start a combustion engine, comprising:

a recoil pulley having a rotational axis;

a movable dampener device including:

at least one movable dampener member with a pivot axis;

at least one reaction portion interposed between the rotational axis of the recoil pulley and the Divot axis of the movable dampener member; and at least one dampener biasing member operatively engaged with the movable dampener device to bias the at least one movable dampener member to a rest position; and a flexible member wound about the recoil pulley and routed at least partially about the at least one reaction portion of the movable dampener device, the flexible member terminating in a handle end, wherein pulling of the handle end of the flexible member displaces the movable dampener member away from its rest position against the bias force of the at least one dampener biasing member and rotates the recoil pulley in an unwind direction.

30. The pull-starter set forth in claim 29 further adapted for actuating at least one startup element of an engine-powered apparatus, wherein the at least one movable dampener member of the movable dampener device is mechanically linked to the at least one startup element.

31. The pull-starter set forth in claim 29 further comprising a housing for carrying the recoil pulley and the movable dampener device, wherein the at least one dampener biasing member is a tension spring having one end attached to the housing and an opposite end attached to the at least one movable dampener member.

32. The pull-starter set forth in claim 29 wherein the movable dampener device includes an overtravel arm movably mounted with respect to the at least one movable dampener member, wherein an overtravel biasing member is interposed between the overtravel arm and the at least one dampener member.

33. The pull-starter set forth in claim 29 wherein the at least one reaction portion of the movable dampener device includes two rollers having the flexible member at least partially wound thereabout.

34. The pull-starter set forth in claim 29 wherein the at least one movable dampener member is pivotably mounted about a rotational axis of the recoil pulley wherein the at least one reaction portion is positioned radially outward of the outer diameter of the recoil pulley and wherein the at least one dampener biasing member is a tension spring having a fixed end and an opposite end attached to a portion of the at least one movable dampener member.

35. A Pull-starter adapted to start a combustion engine, comprising:

a recoil pulley;

a movable dampener device including:

at least one movable dampener member;

at least one reaction portion; and at least one dampener biasing member operatively engaged with the movable dampener device to bias the at least one movable dampener member to a rest position:

the at least one movable dampener member is a translatably mounted dampener member carrying the at least one reaction portion and the at least one dampener biasing member is a tension spring having a fixed end and an opposite end attached to a portion of the translatably mounted dampener member; and a flexible member wound about the recoil pulley and routed at least partially about the at least one reaction portion of the movable dampener device, the flexible member terminating in a handle end, wherein pulling of the handle end of the flexible member displaces the movable dampener member away from its rest position against the bias force of the at least one dampener biasing member and rotates the recoil pulley in an unwind direction.

36. An engine-powered apparatus comprising:

a combustion engine having a crankshaft;

at least one startup element having at least one linkage operatively connected therewith;

a flywheel attached to the crankshaft of the combustion engine;

a pull-starter adapted to start the combustion engine and to actuate the at least one startup element, comprising:

a housing;

a recoil pulley carried by the housing;

a torsional biasing member operatively engaged between the housing and the recoil pulley to rotatably bias the recoil pulley in a wind up direction;

a movable dampener device being at least partially mounted to the housing and including:

at least one movable dampener member being at least indirectly operatively connected to the at least one linkage that is operatively connected to the at least one startup element;

at least one reaction member carried by the at least one movable dampener member; and at least one dampener biasing member operatively engaged between the housing and the at least one movable dampener member to bias the at least one movable dampener member to a rest position; and a flexible member wound about the recoil pulley and routed at least partially about the at least one reaction member of the movable dampener device, the flexible member terminating in a handle end, wherein pulling of the handle end of the flexible member displaces the at least one movable dampener member away from its rest position against the bias force of the at least one dampener biasing member and rotates the recoil pulley in an unwind direction; and a one-way coupling interposed between the flywheel and recoil pulley of the pull-starter.

37. The engine-powered apparatus set forth in claim 36 wherein the at least one startup element includes at least one of an engine-powered apparatus lockout device, an engine startup-assist device, an evaporative emissions reduction device, or an engine on/off switch.

38. The engine-powered apparatus set forth in claim 37 wherein the engine startup-assist device includes at least one of an engine cylinder decompression valve or a carburetor choke valve, further wherein the movable dampener device drives the at least one linkage upon initial pulling of the flexible member which enables at least one of the choke valve to at least partially close and thereafter automatically open or the decompression valve to at least partially open and thereafter automatically close.

39. The engine-powered apparatus set forth in claim 36 wherein the movable dampener device includes an overtravel arm movably mounted with respect to the at least one movable dampener member, wherein an overtravel biasing member is interposed between the overtravel arm and the at least one movable dampener member.

40. The engine-powered apparatus set forth in claim 36 wherein the at least one movable dampener member is pivotably mounted in a location radially adjacent the recoil pulley.

41. The engine-powered apparatus set forth in claim 40 wherein the at least one reaction member of the movable dampener device includes two rollers having the flexible member at least partially wound thereabout.

42. The engine-powered apparatus set forth in claim 40 wherein the at least one reaction member is interposed between a rotational axis of the recoil pulley and a pivot axis of the movable dampener device.

43. The engine-powered apparatus set forth in claim 36 wherein the at least one movable dampener member is pivotably mounted about a rotational axis of the recoil pulley wherein the at least one reaction member is positioned radially outward of the recoil pulley and wherein the at least one dampener biasing member is a tension spring having a fixed end and an opposite end attached to a portion of the at least one movable dampener member.

44. The engine-powered apparatus set forth in claim 36 wherein the at least one movable dampener member is a translatably mounted dampener member carrying the at least one reaction member and further wherein the at least one dampener biasing member is a tension spring having a fixed end and an opposite end attached to a portion of the translatably mounted dampener member.

45. A method of starting a combustion engine of an engine-powered apparatus and of actuating at least one startup element of the engine-powered apparatus, comprising:

providing a recoil pulley;

attaching a flexible member to, and winding the flexible member around, the recoil pulley;

rotatably biasing the recoil pulley in a wind up direction;

routing the flexible member from the recoil pulley, at least partially around a movable dampener member, to a handle;

biasing the movable dampener member toward a rest position under a bias force;

linking a portion of the movable dampener member to the at least one startup element;

coupling the recoil pulley at least indirectly to a crankshaft of the engine; and manually pulling the flexible member so as to move the movable dampener member away from its rest position against the bias force to thereby actuate the at least one startup element and to unwind the flexible member from around the recoil pulley to rotate the recoil pulley in an unwind direction to thereby rotate the crankshaft of the engine.

46. The method set forth in claim 45 wherein the step of linking further comprises providing slack-free lost-motion between the movable dampener member and the at least one startup element.

47. The method set forth in claim 45 wherein the step of biasing the movable dampener member includes rotatably biasing the movable dampener member.

48. The method set forth in claim 45 wherein the step of biasing the movable dampener member includes translatably biasing the movable dampener member.

49. A method of starting a combustion engine of an engine-powered apparatus, comprising:

providing a recoil pulley;

attaching a flexible member to, and winding the flexible member around, the recoil pulley;

rotatably biasing the recoil pulley in a wind up direction using a recoil biasing element;

coupling the recoil pulley at least indirectly to a crankshaft of the engine;

manually pulling the flexible member so as to unwind the flexible member from around the recoil pulley to rotate the recoil pulley in an unwind direction to thereby rotate the crankshaft of the engine; and providing the flexible member of such length that it is not possible, during two-handed pull-starting, for an operator to withdraw the flexible member out of the engine-powered apparatus to such an extent that the flexible member ceases to pay out of the engine-powered apparatus and the recoil pulley no longer rotates.

50. The method set forth in claim 49, further comprising:

routing the flexible member from the recoil pulley, at least partially around a movable dampener member, to a handle;

linking a portion of the movable dampener member to at least one startup element of the engine-powered apparatus; and yieldably biasing the movable dampener member toward a rest position.

51. The method set forth in claim 50, further comprising actuating at least one startup element of the engine-powered apparatus, wherein unwinding of the flexible member from the recoil pulley by a manual pull of the flexible member by an operator causes the recoil pulley to rotate and the movable dampener member to move and thereby actuate the at least one startup element.

52. The method set forth in claim 51, wherein the at least one startup element includes a rotatable choke valve yieldably biased to an open position within a fuel-and-air mixing passage of a carburetor that also has a rotatable throttle valve in the fuel-and-air mixing passage downstream of the choke valve and yieldably biased to an idle position and away from a fast-idle position, wherein the method further comprises:

adjustably linking the movable dampener member to the choke valve to rotate the choke valve toward a closed position from the biased open position when the movable dampener member moves toward an actuated state upon pulling of the flexible member;

enabling the movable dampener member to move out of its actuated state back toward its rest position to permit the choke valve to automatically move at least partially toward its biased open position; and yieldably biasing the movable dampener member toward a rest position under a bias force of sufficient magnitude to move the movable dampener member in a direction toward its rest position immediately upon engine startup so as to permit the choke valve to move at least partially toward its biased open position immediately upon engine startup.

53. A method of starting a combustion engine of an engine-powered apparatus, comprising:

providing a recoil pulley;

attaching a flexible member to, and winding the flexible member around, the recoil pulley;

rotatably yieldably biasing the recoil pulley in a wind up direction;

coupling the recoil pulley at least indirectly to a crankshaft of the engine;

routing the flexible member from the recoil pulley, at least partially around a movable dampener member, to a handle;

linking a portion of the movable dampener member to at least one startup element of the engine-powered apparatus;

yieldably biasing the movable dampener member toward a rest position;

manually pulling the flexible member so as to unwind the flexible member from around the recoil pulley to rotate the recoil pulley in an unwind direction to thereby rotate the crankshaft of the engine, and to move the movable dampener member away from its rest position to thereby actuate at least one startup element of the engine-powered apparatus; and allowing the movable dampener member to move back toward its rest position substantially immediately upon engine startup.

54. The method of claim 53, wherein the at least one startup element includes a rotatable choke valve yieldably biased to an open position within a fuel-and-air mixing passage of a carburetor that also has a rotatable throttle valve in the fuel-and-air mixing passage downstream of the choke valve and yieldably biased to an idle position and away from a fast-idle position, wherein the method further comprises:

adjustably linking the movable dampener member to the choke valve to rotate the choke valve toward a closed position from the biased open position when the movable dampener member moves toward an actuated state upon pulling of the flexible member;

enabling the movable dampener member to move back toward its rest position to permit the choke valve to automatically move at least partially toward its biased open position; and yieldably biasing the movable dampener member toward a rest position under a bias force of sufficient magnitude to move the movable dampener member toward its rest position substantially immediately upon engine startup so as to permit the choke valve to move at least partially toward its biased open position substantially immediately upon engine startup.

55. The method of claim 53, further comprising:

providing the flexible member of such a length that it is not possible, during two-handed pull-starting, for an operator to withdraw the flexible member out of the engine-powered apparatus to such an extent that the flexible member ceases to pay out of the engine-powered apparatus and the recoil pulley no longer rotates.

* * * * *

UNITED STATES PATENT AND TRADEMARK OFFICE

CERTIFICATE OF CORRECTION

PATENT NO. : 7,275,508 B2
APPLICATION NO. : 11/285554
DATED : October 2, 2007
INVENTOR(S) : George M. Pattullol It is certified that error appears in the above-identified patent and that said Letters Patent is hereby corrected as shown below:

Column 21
Line 53, delete “cain” and insert -- cam --.

Column 25
Line 21, delete “Divot” and insert -- pivot --.

Column 26
Line 1, delete “Pull-starter” and insert -- pull-starter --.

Column 26
Line 10, delete “position:” and insert -- position; --.

Signed and Sealed this

Twentieth Day of May, 2008

JON W. DUDAS
*Director of the United States Patent and Trademark Office*